US009468255B2

(12) United States Patent
Dojan et al.

(10) Patent No.: US 9,468,255 B2
(45) Date of Patent: Oct. 18, 2016

(54) SOLE STRUCTURES AND ARTICLES OF FOOTWEAR HAVING A LIGHTWEIGHT MIDSOLE MEMBER WITH PROTECTIVE ELEMENTS

(71) Applicant: NIKE, Inc., Beaverton, OR (US)

(72) Inventors: Frederick J. Dojan, Vancouver, WA (US); Matthew J. Holmes, Portland, OR (US); Troy C. Lindner, Portland, OR (US); Benjamin Nethongkome, Beaverton, OR (US); Dolores S. Thompson, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 15/090,052

(22) Filed: Apr. 4, 2016

(65) Prior Publication Data

US 2016/0213091 A1 Jul. 28, 2016

Related U.S. Application Data

(63) Continuation of application No. 13/835,715, filed on Mar. 15, 2013, now Pat. No. 9,301,566.

(51) Int. Cl.

| | |
|---|---|
| ***A43B 13/12*** | (2006.01) |
| ***A43B 7/14*** | (2006.01) |
| ***A43B 13/22*** | (2006.01) |
| ***A43B 13/04*** | (2006.01) |

(52) U.S. Cl.

CPC ..... *A43B 13/125* (2013.01); *A43B 7/14* (2013.01); *A43B 13/04* (2013.01); *A43B 13/223* (2013.01)

(58) Field of Classification Search

CPC ..... A43B 1/00; A43B 1/0018; A43B 7/14; A43B 13/00; A43B 13/04; A43B 13/023; A43B 13/12; A43B 13/127; A43B 13/122; A43B 13/125; A43B 13/16; A43B 13/223; A43B 13/14; A43B 13/143; A43B 13/145; A43B 13/146

USPC ..... 36/103, 3 B, 25 R

See application file for complete search history.

(56) References Cited

U.S. PATENT DOCUMENTS

| | | | |
|---|---|---|---|
| 1,051,615 | A | 1/1913 | Montllor |
| 1,126,038 | A | 1/1915 | Leonard |
| 2,381,389 | A | 8/1945 | Riesing |
| 3,419,974 | A | 1/1969 | Lange |

(Continued)

FOREIGN PATENT DOCUMENTS

| | | | |
|---|---|---|---|
| CN | 102215710 | A | 10/2011 |
| CN | 102525028 | A | 7/2012 |

(Continued)

OTHER PUBLICATIONS

International Search Report mailed Jun. 13, 2014 in PCT Application No. PCT/US2014/028978.

(Continued)

*Primary Examiner* — Shaun R Hurley
*Assistant Examiner* — Bao-Thieu L Nguyen
(74) *Attorney, Agent, or Firm* — Banner & Witcoff, Ltd.

(57) ABSTRACT

Sole structures for articles of footwear, including athletic footwear, include a relatively soft and lightweight foam midsole component partially covered by at least one more rigid and/or dense cage (protective) component(s) and/or other protective component(s).

13 Claims, 27 Drawing Sheets

(56) References Cited

U.S. PATENT DOCUMENTS

| | | | | |
|---|---|---|---|---|
| 4,026,044 | A | 5/1977 | Senter | |
| 4,043,059 | A | 8/1977 | Rathmell | |
| 4,261,114 | A | 4/1981 | Viletto | |
| 4,489,509 | A | 12/1984 | Libit | |
| 4,677,769 | A | 7/1987 | Ahmad et al. | |
| 4,785,556 | A | 11/1988 | Blair | |
| 4,794,707 | A | 1/1989 | Franklin et al. | |
| 4,823,482 | A | 4/1989 | Lakic | |
| 4,854,057 | A | 8/1989 | Misevich et al. | |
| 4,918,838 | A | 4/1990 | Chang | |
| 5,014,449 | A | 5/1991 | Richard et al. | |
| 5,143,762 | A | 9/1992 | Ho | |
| 5,224,810 | A | 7/1993 | Pitkin | |
| 5,367,792 | A | 11/1994 | Richard et al. | |
| 5,625,966 | A | 5/1997 | Perotto et al. | |
| 5,758,435 | A | 6/1998 | Miyata | |
| D398,743 | S | 9/1998 | Rask | |
| 5,918,385 | A | 7/1999 | Sessa | |
| 6,128,834 | A | 10/2000 | Vecchiola et al. | |
| 6,199,302 | B1 | 3/2001 | Kayano | |
| 6,418,641 | B1 | 7/2002 | Schenkel | |
| 6,449,878 | B1 | 9/2002 | Lyden | |
| D468,082 | S | 1/2003 | Brown | |
| 6,990,755 | B2 | 1/2006 | Hatfield et al. | |
| 7,080,467 | B2 | 7/2006 | Marvin et al. | |
| 7,100,308 | B2 | 9/2006 | Aveni | |
| 7,197,840 | B2 | 4/2007 | Nakano | |
| 7,437,835 | B2 | 10/2008 | Marvin et al. | |
| 7,540,099 | B2 | 6/2009 | Meschan et al. | |
| 7,941,938 | B2 | 5/2011 | Yu et al. | |
| D643,189 | S | 8/2011 | Teteriatnikov | |
| 8,186,078 | B2 | 5/2012 | Avar et al. | |
| 8,272,149 | B2 | 9/2012 | Cooper et al. | |
| 8,516,723 | B2 | 8/2013 | Ferrigan et al. | |
| 8,539,698 | B1 | 9/2013 | Woodruff | |
| 9,044,067 | B2 | 6/2015 | Edington et al. | |
| 9,301,566 | B2 * | 4/2016 | Dojan | A43B 1/0018 |
| 2002/0069557 | A1 | 6/2002 | Miller et al. | |
| 2004/0187350 | A1 | 9/2004 | Lacorazza et al. | |
| 2005/0016021 | A1 | 1/2005 | Marvin et al. | |
| 2005/0108901 | A1 | 5/2005 | Yamashita et al. | |
| 2005/0115113 | A1 | 6/2005 | Miller et al. | |
| 2005/0241179 | A1 | 11/2005 | Chen | |
| 2006/0001206 | A1 | 1/2006 | Jen | |
| 2006/0163783 | A1 | 7/2006 | Yang | |
| 2006/0191163 | A1 | 8/2006 | Nakano | |
| 2007/0107259 | A1 | 5/2007 | Kilgore et al. | |
| 2007/0266592 | A1 | 11/2007 | Smith et al. | |
| 2008/0115389 | A1 | 5/2008 | Hsieh | |
| 2008/0244926 | A1 | 10/2008 | Yu et al. | |
| 2008/0301974 | A1 | 12/2008 | Bowen et al. | |
| 2009/0049711 | A1 | 2/2009 | Finch | |
| 2009/0113757 | A1 | 5/2009 | Banik | |
| 2009/0113762 | A1 | 5/2009 | Leimer et al. | |
| 2009/0235556 | A1 | 9/2009 | Reid | |
| 2009/0288314 | A1 | 11/2009 | Kay | |
| 2009/0297783 | A1 | 12/2009 | Yang | |
| 2010/0071232 | A1 | 3/2010 | Steele | |
| 2010/0122471 | A1 | 5/2010 | Edington et al. | |
| 2010/0139127 | A1 | 6/2010 | Huang | |
| 2010/0146824 | A1 | 6/2010 | Sensini | |
| 2010/0223818 | A1 | 9/2010 | Hampton | |
| 2011/0035960 | A1 | 2/2011 | Werremeyer et al. | |
| 2011/0035963 | A1 | 2/2011 | Baker et al. | |
| 2011/0088282 | A1 | 4/2011 | Dojan et al. | |
| 2011/0088285 | A1 | 4/2011 | Dojan et al. | |
| 2011/0167672 | A1 | 7/2011 | Bond et al. | |
| 2011/0247243 | A1 | 10/2011 | Eder et al. | |
| 2011/0252668 | A1 | 10/2011 | Chen | |
| 2012/0124865 | A1 | 5/2012 | Opie et al. | |
| 2012/0186107 | A1 | 7/2012 | Crary et al. | |
| 2012/0222332 | A1 | 9/2012 | Greene et al. | |
| 2013/0019497 | A1 | 1/2013 | Sullivan et al. | |
| 2013/0031805 | A1 | 2/2013 | Crowley, II et al. | |
| 2013/0036633 | A1 | 2/2013 | Lee | |
| 2013/0074363 | A1 | 3/2013 | Adams | |
| 2013/0125421 | A1 | 5/2013 | Stegmaier et al. | |
| 2013/0125424 | A1 | 5/2013 | Lee et al. | |
| 2013/0326910 | A1 | 12/2013 | Bock | |
| 2014/0123522 | A1 | 5/2014 | Rustam et al. | |
| 2014/0150297 | A1 | 6/2014 | Holmes et al. | |
| 2014/0150298 | A1 | 6/2014 | Crowley et al. | |
| 2014/0215862 | A1 | 8/2014 | Curl et al. | |

FOREIGN PATENT DOCUMENTS

| | | | |
|---|---|---|---|
| DK | 200800278 | A | 8/2009 |
| EP | 2225960 | A1 | 9/2010 |
| HU | 219321 | B | 3/2001 |
| WO | 0032069 | A1 | 6/2000 |
| WO | 2009106076 | A1 | 9/2009 |

OTHER PUBLICATIONS

International Search Report mailed Jun. 13, 2014 for PCT Application No. PCT/US2014/027221.

International Search Report mailed Sep. 16, 2014 in PCT Application No. PCT/US2014/025607.

Non Final Rejection issued on Sep. 30, 2015 in U.S. Appl. No. 13/835,715.

* cited by examiner

SOLE STRUCTURES AND ARTICLES OF FOOTWEAR HAVING A LIGHTWEIGHT MIDSOLE MEMBER WITH PROTECTIVE ELEMENTS

CROSS REFERENCE TO RELATED APPLICATIONS

This application is a continuation application of application Ser. No. 13/835,715, filed Mar. 15, 2013, which is incorporated herein by reference.

FIELD OF THE INVENTION

The present invention relates to the field of footwear. More specifically, aspects of the present invention pertain to sole structures and/or articles of footwear (e.g., athletic footwear) that include a relatively soft and/or lightweight foam midsole component partially covered by protective components.

BACKGROUND

Conventional articles of athletic footwear include two primary elements, namely, an upper and a sole structure. The upper provides a covering for the foot that securely receives and positions the foot with respect to the sole structure. In addition, the upper may have a configuration that protects the foot and provides ventilation, thereby cooling the foot and removing perspiration. The sole structure is secured to a lower surface of the upper and generally is positioned between the foot and any contact surface. In addition to attenuating ground reaction forces and absorbing energy, the sole structure may provide traction and control potentially harmful foot motion, such as over pronation. The general features and configurations of the upper and the sole structure are discussed in greater detail below.

The upper forms a void on the interior of the footwear for receiving the foot. The void has the general shape of the foot, and access to the void is provided at an ankle opening. Accordingly, the upper extends over the instep and toe areas of the foot, along the medial and lateral sides of the foot, and around the heel area of the foot. A lacing system often is incorporated into the upper to selectively change the size of the ankle opening and to permit the wearer to modify certain dimensions of the upper, particularly girth, to accommodate feet with varying proportions. In addition, the upper may include a tongue that extends under the lacing system to enhance the comfort of the footwear (e.g., to moderate pressure applied to the foot by the laces), and the upper also may include a heel counter to limit or control movement of the heel.

The sole structure generally incorporates multiple layers that are conventionally referred to as an "insole," a "midsole," and an "outsole." The insole (which also may constitute a sock liner) is a thin member located within the upper and adjacent the plantar (lower) surface of the foot to enhance footwear comfort, e.g., to wick away moisture and provide a soft, comfortable feel. The midsole, which is traditionally attached to the upper along the entire length of the upper, forms the middle layer of the sole structure and serves a variety of purposes that include controlling foot motions and attenuating impact forces. The outsole forms the ground-contacting element of footwear and is usually fashioned from a durable, wear-resistant material that includes texturing or other features to improve traction.

The primary element of a conventional midsole is a resilient, polymer foam material, such as polyurethane foam or ethylvinylacetate ("EVA") foam, that extends throughout the length of the footwear. The properties of the polymer foam material in the midsole are primarily dependent upon factors that include the dimensional configuration of the midsole and the specific characteristics of the material selected for the polymer foam, including the density and/or hardness of the polymer foam material. By varying these factors throughout the midsole, the relative stiffness, degree of ground reaction force attenuation, and energy absorption properties may be altered to meet the specific demands of the activity for which the footwear is intended to be used.

Despite the numerous available footwear models and characteristics, new footwear models and constructions continue to develop and are a welcome advance in the art.

SUMMARY OF THE INVENTION

This Summary is provided to introduce some general concepts relating to this invention in a simplified form that are further described below in the Detailed Description. This Summary is not intended to identify key features or essential features of the invention.

While potentially useful for any desired types or styles of shoes, aspects of this invention may be of particular interest for sole structures used in articles of athletic footwear, including basketball shoes, running shoes, cross-training shoes, cleated shoes, tennis shoes, golf shoes, etc.

More specific aspects of this invention relate to sole structures for articles of footwear that include a first polymeric foam member for supporting at least a heel and midfoot area of a wearer's foot. An exposed outer edge of this first polymeric foam member includes a billows structure that, at least in some examples, extends continuously from a medial midfoot or forefoot area of the first polymeric foam member, around the rear heel area, and to a lateral midfoot or forefoot area of the first polymeric foam member. Other billows structures, e.g., including interwoven billows, support ribs, etc., may be provided in at least some examples of this invention. These billow structures may include two to eight billow outer ridges connected by billow interstitial areas located between adjacent billow outer ridges.

Sole structures according to other examples of this invention may include a polymeric foam member (optionally a lightweight, low density polymeric foam material, such as a foam material having a density of less than 0.25 g/cm$^3$) for supporting at least a heel and midfoot area of a wearer's foot. An exposed outer edge of this polymeric foam member may include:

(a) a first billows structure that includes: a first outer billow ridge, a second outer billow ridge, a third outer billow ridge, a first interstitial region located between the first and second outer billow ridges, and a second interstitial region located between the second and third outer billow ridges, and (b) a second billows structure that includes: a fourth outer billow ridge, a fifth outer billow ridge, and a third interstitial region located between the fourth and fifth outer billow ridges, wherein the fourth outer billow ridge originates in the first interstitial region and the fifth outer billow ridge originates in the second interstitial region. The exposed outer edge of the polymeric foam member may further include another billows structure, e.g., wherein an outer billow ridge of that billows structure originates in the third interstitial region. One billows structure may extend around a rear heel area of the sole structure, while another may be located at a side midfoot region of the sole structure. An outsole component may be engaged with a bottom surface of the polymeric foam member.

Another example sole structure according to some examples of this invention includes: a first polymeric foam member for supporting at least a heel area of a wearer's foot, wherein the first polymeric foam member constitutes an outer shell having: (a) a lateral side wall, (b) a medial side wall, (c) a rear heel wall connecting the medial side wall and the lateral side wall, (d) a bottom wall connecting the medial side wall, the lateral side wall, and the rear heel wall, and (e) an open end opposite the rear heel wall, and this first polymeric foam member extends around a rear heel area of the sole structure. A second polymeric foam member has a heel portion at least partially received in a space defined by the outer shell of the first polymeric foam member, wherein a forefoot end of the second polymeric foam member extends beyond the open end of the first polymeric foam member. This second polymeric foam member has a density that is less than a density of the first polymeric foam member, and a portion of a bottom surface of the second polymeric foam member is exposed at a bottom forefoot area of the article of footwear. If desired, a protective element may be engaged with the bottom surface of the second polymeric foam member in the bottom forefoot area.

Yet another sole structure in accordance with some examples of this invention will include: (a) a polymeric foam member for supporting an entire plantar surface of a wearer's foot, wherein the polymeric foam member includes a foam material having a density of less than 0.25 g/cm$^3$, and (b) a protective member engaged with the polymeric foam member to cover at least 80% of a surface area of a bottom surface of the polymeric foam member, wherein the protective member constitutes a web base surface with a plurality of traction elements extending downward from the web base surface, wherein a thickness of a majority of the web base surface at locations between the plurality of traction elements is less than 2 mm thick.

Additional aspects of this invention relate to articles of footwear including sole structures of the various types described above engaged with an upper. Still additional aspects of this invention relate to methods for making sole structures and/or articles of footwear of the various types described above (and described in more detail below). More specific aspects of this invention will be described in more detail below.

BRIEF DESCRIPTION OF THE DRAWINGS

The foregoing Summary of the Invention, as well as the following Detailed Description of the Invention, will be better understood when considered in conjunction with the accompanying drawings in which like reference numerals refer to the same or similar elements in all of the various views in which that reference number appears.

DETAILED DESCRIPTION OF THE INVENTION

Figure 1A:
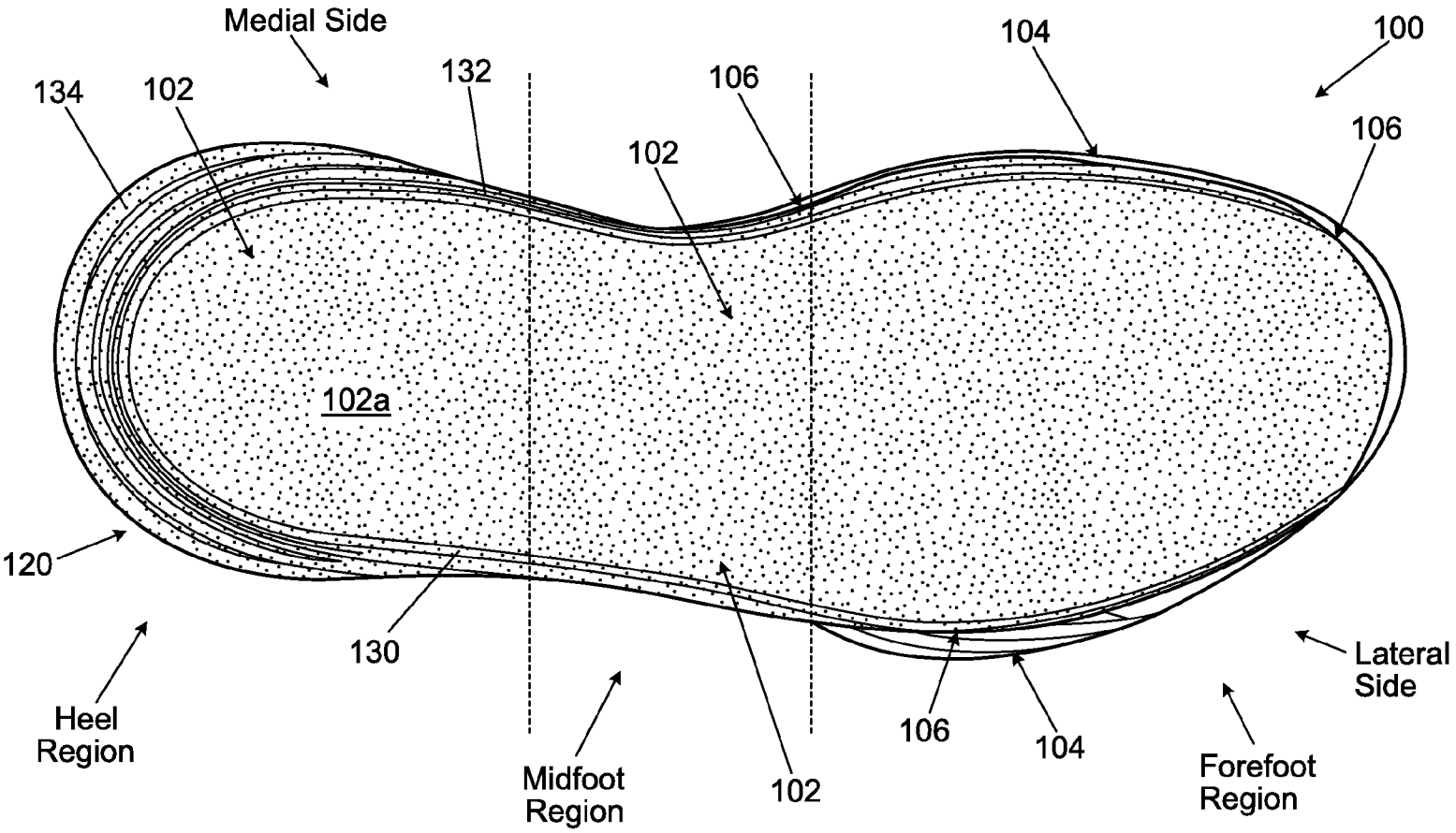
FIGS. 1A-1F illustrate a sole structure according to one example of this invention.

In the following description of various examples of footwear structures and components according to the present invention, reference is made to the accompanying drawings, which form a part hereof, and in which are shown by way of illustration various example structures and environments in which aspects of the invention may be practiced. It is to be understood that other structures and environments may be utilized and that structural and functional modifications may be made from the specifically described structures and functions without departing from the scope of the present invention.

I. General Description of Aspects of this Invention

Some aspects of this invention relate to sole structures and/or articles of footwear (e.g., athletic footwear) that include a relatively soft and lightweight foam midsole component partially covered by at least one more rigid and/or dense cage (protective) component(s) and/or other protective components. More specific features and aspects of this invention will be described in more detail below.

A. Features of Sole Structures and Articles of Footwear According to Examples of this Invention Some aspects of this invention relate to sole structures for articles of footwear and articles of footwear (or other foot-receiving devices), including athletic footwear, having such sole structures. Sole structures for articles of footwear according to at least some examples of this invention may include a first polymeric foam member for supporting at least a heel and midfoot area of a wearer's foot. An exposed outer edge of this first polymeric foam member includes a billows structure that extends continuously from a medial midfoot or forefoot area of the first polymeric foam member, around the rear heel area, to a lateral midfoot or forefoot area of the first polymeric foam member. This billows structure may include two to eight billow outer ridges connected by billow interstitial areas located between adjacent billow outer ridges.

Sole structures in accordance with at least some examples of this invention may include outsole components (e.g., made of rubber, phylon, phylite, thermoplastic polyurethane, or the like) on the bottom surface(s) of one or more of foam protective components and/or the foam midsole component (e.g., in one of the exposed spaces). The outsole component (s) may provide, for example, hardness, strength, wear resistance, and traction (e.g., by providing texture, cleats, or other traction-enhancing structures on the bottom surface of the sole structure). In some example structures according to this invention, several independent outsole components will be provided at various discrete locations around the bottom of the sole structure. Outsole components also may be considered a "protective" component for the lightweight midsole component.

If desired, in accordance with at least some examples of this invention, at least some portion of outer side edges of one or more of the lighter-weight and/or less dense foam midsole material components and/or a more dense protective component (optionally made from a heavier weight or more dense polymeric foam material), may include a billowed structure (described in more detail below). Additionally or alternatively, if desired, at least some portion of the foam midsole component may include a billowed structure, e.g., optionally adjacent the billowed structure of the one or more protective components (if they are billowed). While any number of individual billow structures are possible on the various components without departing from this invention, in some examples, in a top-to-bottom direction, an individual sole structure may include from 2 to 8 billows, and in some examples, from 3-6 billows.

Sole structures according to other examples of this invention may include a polymeric foam member (optionally a lightweight, low density polymeric foam material, such as a foam material having a density of less than 0.25 g/cm$^3$) for supporting at least a heel and midfoot area of a wearer's foot. An exposed outer edge of this polymeric foam member may include:

- a first billows structure that includes: a first outer billow ridge, a second outer billow ridge, a third outer billow ridge, a first interstitial region located between the first and second outer billow ridges, and a second interstitial region located between the second and third outer billow ridges, and
- a second billows structure that includes: a fourth outer billow ridge, a fifth outer billow ridge, and a third interstitial region located between the fourth and fifth outer billow ridges, wherein the fourth outer billow ridge originates in the first interstitial region and the fifth outer billow ridge originates in the second interstitial region. The exposed outer edge of the polymeric foam member may further include another billows structure, e.g., wherein an outer billow ridge of that billows structure originates in the third interstitial region. One billows structure may extend around a rear heel area of the sole structure, while another may be located at a side midfoot region of the sole structure. An outsole component may be engaged with a bottom surface of the polymeric foam member.

Another example sole structure according to some examples of this invention includes: a first polymeric foam member for supporting at least a heel area of a wearer's foot, wherein the first polymeric foam member constitutes an outer shell having: (a) a lateral side wall, (b) a medial side wall, (c) a rear heel wall connecting the medial side wall and the lateral side wall, (d) a bottom wall connecting the medial side wall, the lateral side wall, and the rear heel wall, and (e) an open end opposite the rear heel wall, and this first polymeric foam member extends around a rear heel area of the sole structure. A second polymeric foam member has a heel portion at least partially received in a space defined by the outer shell of the first polymeric foam member, wherein a forefoot end of the second polymeric foam member extends beyond the open end of the first polymeric foam member. This second polymeric foam member has a density that is less than a density of the first polymeric foam member, and a portion of a bottom surface of the second polymeric foam member is exposed at a bottom forefoot area of the article of footwear. If desired, a protective element may be engaged with the bottom surface of the second polymeric foam member in the bottom forefoot area.

Yet another sole structure in accordance with some examples of this invention will include: (a) a polymeric foam member for supporting an entire plantar surface of a wearer's foot, wherein the polymeric foam member includes a foam material having a density of less than 0.25 g/cm$^3$, and (b) a protective member engaged with the polymeric foam member to cover at least 80% of a surface area of a bottom surface of the polymeric foam member, wherein the protective member constitutes a web base surface with a plurality of traction elements extending downward from the web base surface, wherein a thickness of a majority of the web base surface at locations between the plurality of traction elements is less than 2 mm thick.

Still additional aspects of this invention relate to articles of footwear including uppers (e.g., of any desired design, construction, or structure, including conventional designs, constructions, or structures) engaged with sole structures of the various types described above.

Additional aspects of this invention relate to methods of making articles of footwear or various components thereof. One more specific aspect of this invention relates to methods for making sole structures for articles of footwear of the various types and constructions described above. While the various components and parts of the sole structures and articles of footwear according to aspects of this invention may be made in manners that are conventionally known and used in the art, examples of the method aspects of this invention relate to combining the sole structure and/or footwear parts and engaging them together in manners that produce the various structures described above.

Given the general description of features, aspects, structures, and arrangements according to the invention provided above, a more detailed description of specific example articles of footwear and methods in accordance with this invention follows.

II. Detailed Description of Example Sole Structures and Articles of Footwear According to this Invention Referring to the figures and following discussion, various sole structures, articles of footwear, and features thereof in accordance with the present invention are disclosed. The sole structures and footwear depicted and discussed are athletic shoes, and the concepts disclosed with respect to various aspects of this footwear may be applied to a wide range of athletic footwear styles, including, but not limited to: walking shoes, tennis shoes, soccer shoes, football shoes, basketball shoes, running shoes, cross-training shoes, cleated shoes, golf shoes, etc. In addition, at least some concepts and aspects of the present invention may be applied to a wide range of non-athletic footwear, including work boots, sandals, loafers, and dress shoes. Accordingly, the present invention is not limited to the precise embodiments disclosed herein, but it applies to footwear generally.

FIGS. 1A through 1F illustrate various views of an example sole structure 100 for an article of footwear that includes at least some aspects of this invention. For purposes of this disclosure, and as shown in FIG. 1A, portions of an article of footwear (and the various component parts thereof) may be identified based on regions of the foot located at or near that portion of the article of footwear when the footwear is worn on the properly sized foot. For example, as shown in FIG. 1A, an article of footwear and/or a sole structure may be considered as having a "forefoot region" at the front of the foot, a "midfoot" region at the middle or arch area of the foot, and a "heel region" at the rear of the foot. Footwear and/or sole structures also include a "lateral side" (the "outside" or "little toe side" of the foot) and a "medial side" (the "inside" or "big toe side" of the foot). The forefoot region generally includes portions of the footwear corresponding to the toes and the joints connecting the metatarsals with the phalanges. The midfoot region generally includes portions of the footwear corresponding with the arch area of the foot. The heel region generally corresponds with the rear portions of the foot, including the calcaneus bone. The lateral and medial sides of the footwear extend through the forefoot, midfoot, and heel regions and generally correspond with opposite sides of the footwear (and may be considered as being separated by a central longitudinal axis). These regions (although separated by dividing lines in FIG. 1A) and sides are not intended to demarcate precise areas of footwear. Rather, the terms "forefoot region," "midfoot region," "heel region," "lateral side," and "medial side" are intended to represent general areas of an article of footwear and the various components thereof to aid the in discussion that follows.

Figure 1B:
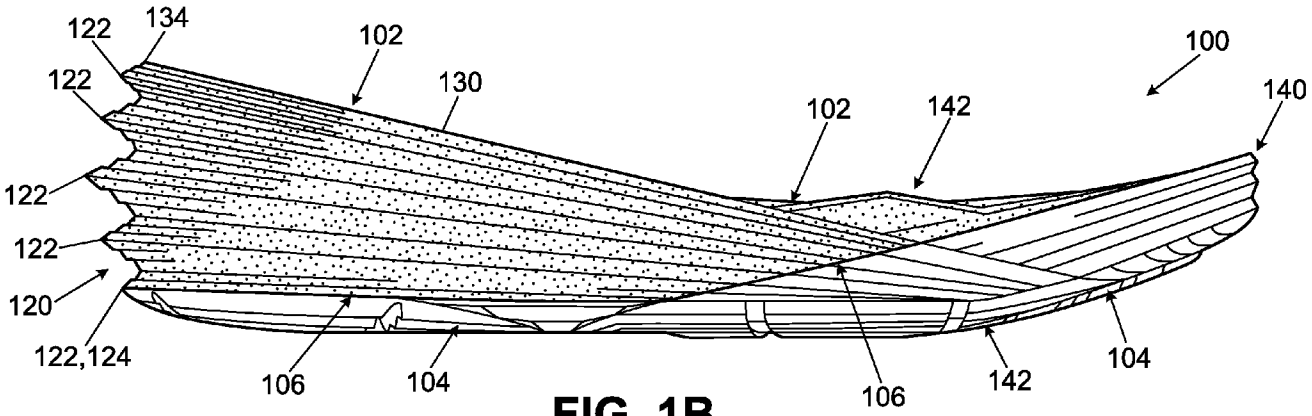
Figure 1C:
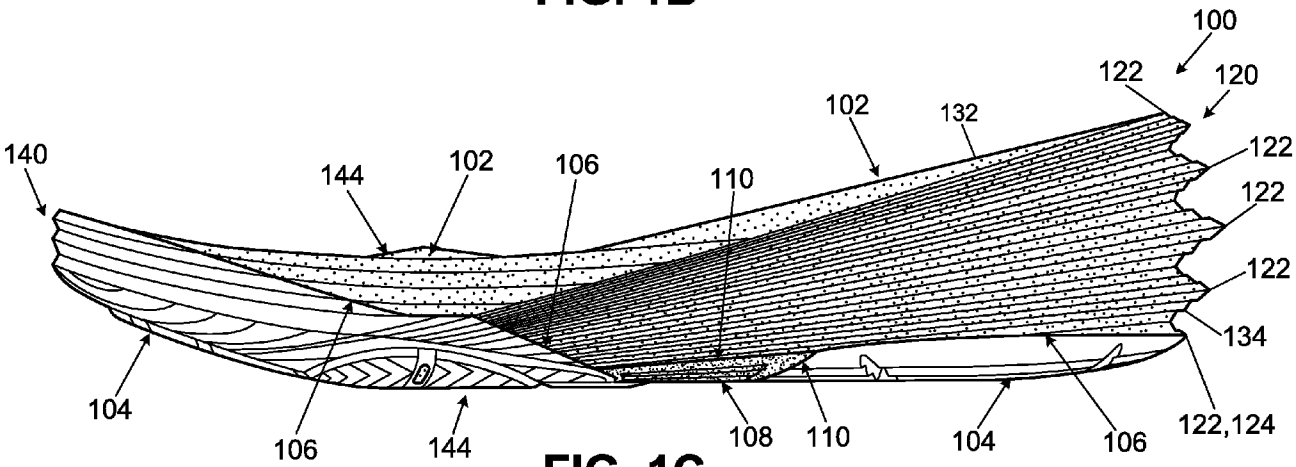
Figure 1D:
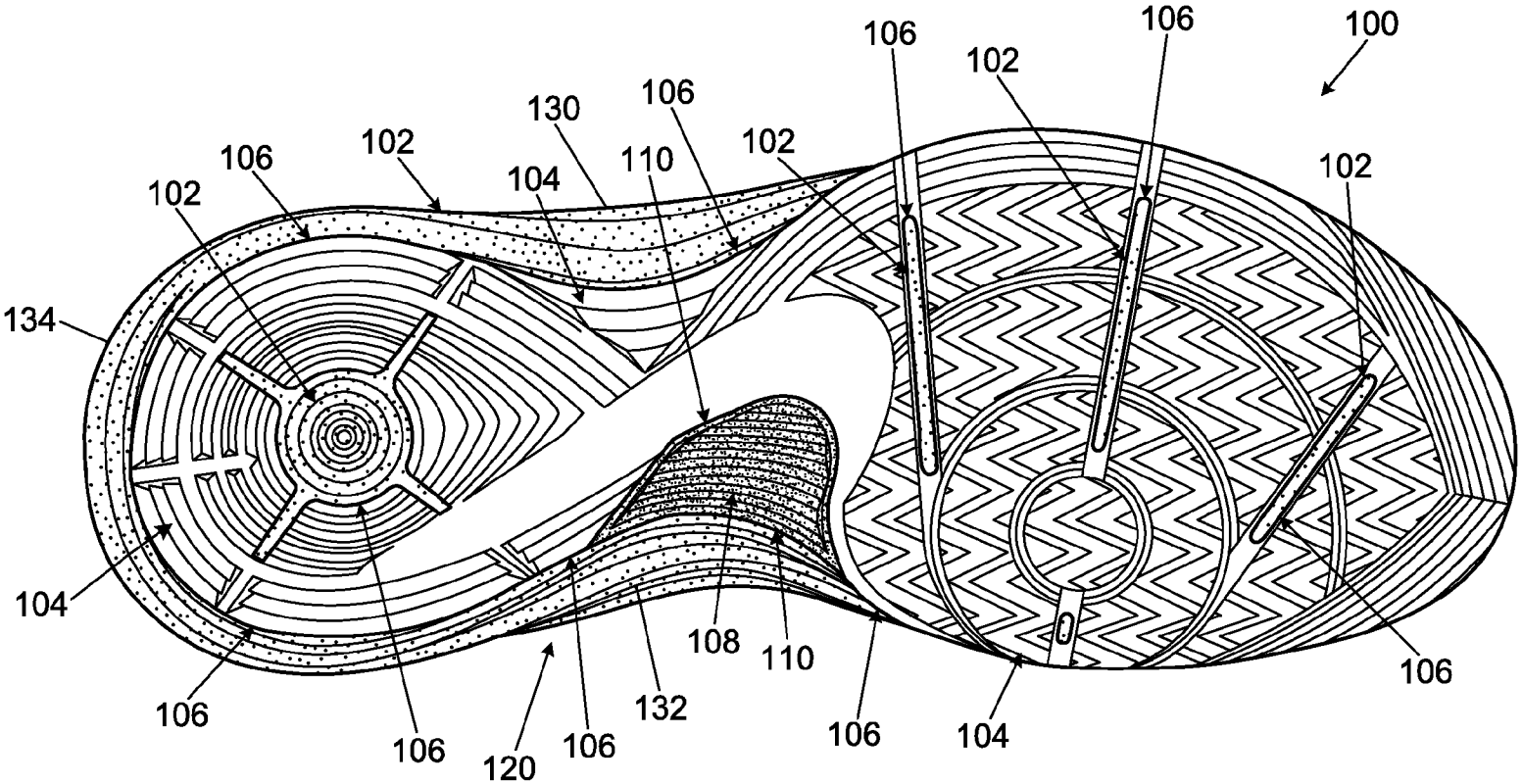
Figure 1F:
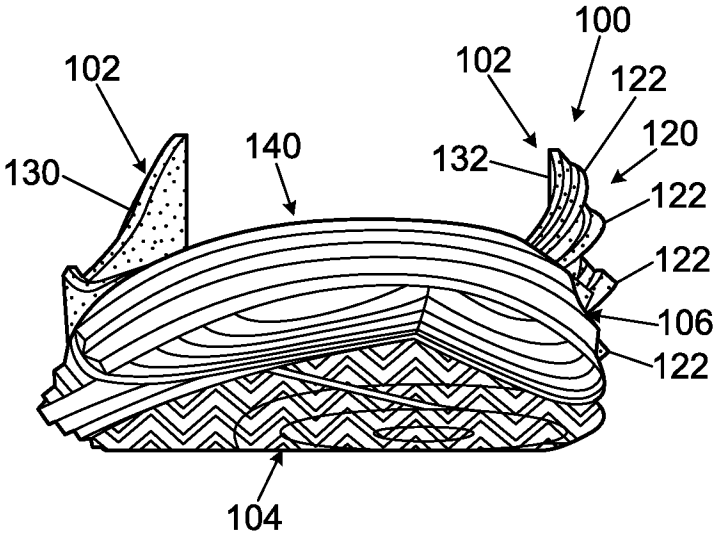
Figure 1E:
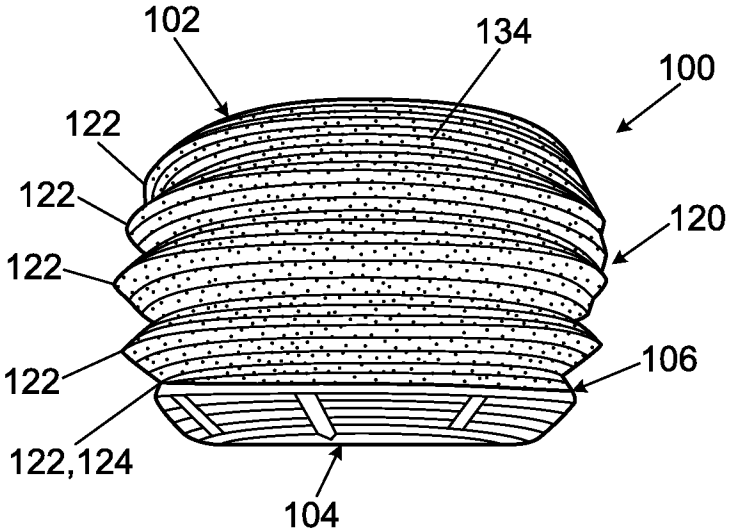

FIG. 1A shows a top view of the sole structure 100, FIG. 1B shows a lateral side view, FIG. 1C shows a medial side view, FIG. 1D shows a bottom view, FIG. 1E shows a heel or rear view, and FIG. 1F shows a toe or front side view. As shown in FIGS. 1A through 1F, this example sole structure 100 includes a single midsole component 102 that extends continuously in this particular structure 100 to support a complete plantar surface of a wearer's foot, i.e., from the rear heel area of the sole 100 to the front toe area of the sole 100 and from the lateral side edge to the medial side edge of the sole 100. While other midsole constructions are possible, in accordance with some examples of this invention, the midsole component 102 may constitute a foam material (such as ethylvinylacetate ("EVA") foam, polyurethane foam, phylon foam, and the like). The top surface 102*a* of the midsole component 102 may be contoured, e.g., to comfortably support and/or help position a plantar surface of a wearer's foot.

In some examples of this invention, the midsole component 102 will be at least partially made from a foam material having a density of less than 0.25 g/cm$^3$ (and in some examples, a density of less than 0.2 g/cm$^3$, within the range of 0.075 to 0.2 g/cm$^3$, and even within the range of 0.1 to 0.18 g/cm$^3$). If desired, the foam material of midsole component 102 may include one or more openings defined therein and/or another impact-force attenuating component included with it, such as a fluid-filled bladder, a mechanical shock absorbing member, etc. In certain embodiments of this invention, the entire midsole component 102 will constitute this lightweight foam material (e.g., with a density feature as described above) and will extend to support the complete foot of the wearer (e.g., the complete plantar surface). In the example structure 100 as illustrated in FIGS. 1A through 1F, the foam midsole component 102 is shown as a separate part from a protective component 104 (e.g., one or more of: another, more dense or harder midsole material (e.g., polymeric foam material); an outsole material; a "cage" or "carrier member; etc.) by (broken) junction line 106 (this broken line 106 is provided as an illustrative aid in the drawings only to highlight the change locations between materials 102/104 in these figures). In this illustrated example, the midsole component 102 generally lies above the protective component 104 (and may be at least partially contained by the protective component 104). As other options, the midsole component 102 may be made from multiple component midsole (e.g., foam) parts, if desired, and/or the sole structure may include multiple protective component parts 104.

As some even more specific examples, at least some of the midsole component 102 may be made from a foam material as described, for example, in U.S. Pat. No. 7,941,938, which patent is entirely incorporated herein by reference. In at least some example sole structures 100 according to this invention, all, substantially all, or at least some portion of the midsole component 102 may include a foam material comprising a reaction product of about 10 to about 100 parts per hundred hydrogenated or non-hydrogenated acrylonitrile butadiene copolymer, 0 to about 40 parts per hundred modified hydrogenated acrylonitrile butadiene copolymer, and 0 to about 90 parts per hundred alpha olefin copolymer, and at least one additive in an amount suitable to form the foam material. This foam material may have a lightweight, spongy feel. The density of the foam material may be generally less than 0.25 g/cm$^3$, less than 0.20 g/cm$^3$, less than 18 g/cm$^3$, less than 0.15 g/cm$^3$, less than 0.12 g/cm$^3$, and in some examples, about 0.10 g/cm$^3$. As example ranges, the foam density may fall within the range, for example, of 0.05 to 0.25 g/cm$^3$ or within the various ranges noted above.

Also, in accordance with at least some examples of this invention, the resiliency of the foam material for the midsole component 102 may be greater than 40%, greater than 45%, at least 50%, and in one aspect from 50-70%. Compression set may be 60% or less, 50% or less, 45% or less, and in some instances, within the range of 20 to 60%. The hardness (Durometer Asker C) of the foam material for this example midsole component 102 may be, for example, 25 to 50, 25 to 45, 25 to 35, or 35 to 45, e.g., depending on the type of footwear. The tensile strength of the foam material 102 may be at least 15 kg/cm$^2$, and typically 15 to 40 kg/cm$^2$. The elongation % is 150 to 500, typically above 250. The tear strength is 6-15 kg/cm, typically above 7. In at least some example constructions according to the invention, the foam material of at least some portion of the midsole component 102 may have lower energy loss and may be more lightweight than traditional EVA foams. The energy loss may be less than 30%, and optionally within the range of about 20% to about 30%. As additional examples, if desired, at least some portion of the midsole component 102 may be made from foam materials used in the LUNAR family of footwear products available from NIKE, Inc. of Beaverton, Oreg.

While the above paragraphs describe potential properties and features of foam materials for midsole components 102 in accordance with some examples of this invention, those skilled in the art will recognize that the midsole component 102 may have other desired properties, features, and/or combinations of features without departing from this invention. Other lightweight and/or low density foams also may be used. Because of the protective components 104 described in more detail below, the lightweight foam midsole component 102 need not necessarily have sufficient hardness, durability, and/or abrasion resistance to directly contact the ground in use (at least not at some higher impact ground contact locations).

The protective component 104 in this example sole structure 100 may be made from any desired materials without departing from the invention. For example, the protective component 104 may be made from conventional outsole material, such as rubber, thermoplastic polyurethane (TPU), or the like. As another example, the protective component

104 may be made, at least in part, from a polymeric foam cage or carrier material, like those described in U.S. Pat. No. 7,941,938 identified above. Other conventional polymer foam materials also may be used for protective component 104.

The foam midsole component 102 and the protective component 104 may be engaged together in any desired manner without departing from the invention, including in conventional manners as are known and used in the art (e.g., via cements or adhesives, via mechanical connectors, etc.). In this illustrated example, the protective component 104 fits within one or more recesses formed in the bottom and/or side surfaces of the polymeric foam component 102. The recess(es), when present, may be formed during the molding process (or other formation process) in which the lightweight foam component 102 is formed. Alternatively, the recesses may be produced after the lightweight foam component 102 is formed, e.g., by a cutting or grinding action. The protective component 104 may include traction elements or other features for engaging the ground or other contact surface in use, such as herringbone structures, raised ribs or ridges, recessed grooves, etc., including conventional traction elements as are known and used in the art. As additional examples, the bottom surface of the protective component 104 may be formed to include receptacles for receiving removable cleats and/or may be formed to include actual cleat elements extending from the bottom surface thereof.

As further illustrated in FIG. 1D, the bottom surface of the protective component 104 does not need to completely cover the bottom surface of the midsole component 102. Rather, some spaces or holes may be provided in the protective component 104 through which the bottom surface of the lightweight foam material 102 is exposed. This feature can provide several potential advantages. For example, eliminating some of the protective component 104 may lighten the weight of the sole structure 100. Additionally, as illustrated in FIG. 1D, the breaks or gaps in the protective component 104 may be provided along desired lines of flex of the protective component 104 (e.g., elongated slots or gaps in the forefoot area, as shown in FIG. 1D), thereby helping maintain the overall flexibility (and optionally a more natural flexibility) of the overall sole structure 100. The large opening in the protective component 104 at the heel area of this example sole structure 100 provides a relatively large and soft "crash pad" for the heel, e.g., to provide better comfort and feel as the wearer's heel strikes the ground, e.g., when landing a step or jump. One skilled in the art, given the benefit of this disclosure, will understand that the openings in the protective component 104 are optional, and, when present, they may be provided in any desired sizes, shapes, and/or numbers without departing from the invention. Preferably, however, areas of high wear on the bottom surface of the sole structure 100 will include some layer of a protective component 104 overlying the lightweight (and more fragile) polymeric midsole component 102, to help protect the structural integrity of the midsole component 102.

As best shown in FIGS. 1C and 1D, this example sole structure 100 includes a further element, namely, support plate 108 provided in the central or midfoot area of the sole structure 100. This support plate 108, provides additional support for the arch area of this sole structure 100. In FIGS. 1C and 1D, the support plate 108 is shown separated from the midsole component 102 and/or the protective component 104 by (broken) junction line 110. This broken line 110 is provided as an illustrative aid in the drawings only to highlight the change locations between support plate 108 and materials 102/104 in these figures. In this illustrated example, the support plate 108 may be at least partially sandwiched or layered between midsole component 102 and protective component 104 in at least the arch area of the sole structure 100. The support plate may be engaged with one or more of the midsole component 102 and/or protective component 104 by adhesives or cements, by mechanical connectors, and/or by any other desired manner, including conventional manners known or used in this art. The support plate 108 may be made from any desired number of pieces or parts and/or from any desired materials without departing from the invention, including conventional arch support materials and/or parts as are known and used in the art. Some more specific examples of materials include: thermoplastic polyurethanes, nylon based polymer materials (e.g., PEBAX®), carbon fiber reinforced polymeric materials, glass fiber reinforced polymeric materials, other composite materials, and the like.

FIGS. 1A through 1F show another feature that may be included in sole structures 100 in accordance with at least some examples of this invention. As shown in these figures, at least some portion of the outer edges or sides of the midsole foam component 102 and/or the protective component 104 may include a "billowed structure" 120. The terms "billowed structure" or "billows structure," as used herein, mean that the exterior surface shape of the element has the exterior surface shape of a billow, e.g., a wave like structure with a series of wave peaks (the outermost portion or ridge) and valleys between the wave peaks. In a sole structure, a "billowed structure" need not expand and compress in the same manner of a conventional bellow, but rather, the term relates more generally to the shape of the exterior surface of the structure. In the illustrated example sole structure 100, the lightweight midsole foam component 102 has a series of 4½ billows 122 (e.g., appearing like four stacked disks around the rear heel area), and the protective component 104 includes ½ billow 124 (which joins with the bottom ½ billow 122 of the midsole foam component 102 to complete the bottommost billow in this sole structure 100). At least some portion of the billowed structure 120 may be provided on side walls of the midsole component 102 (and its billowed structure 120) that are raised up from the top surface 102*a* of the midsole component 102, e.g., so that the midsole component at least partially wraps around the wearer's foot (e.g., at least at the heel area). As some more specific examples, the outer shell of the midsole component 102 (with the billows structure 120 formed in it) may include a lateral side wall 130, a medial side wall 132, a rear heel wall 134 connecting the medial side wall 132 and the lateral side wall 130, and the top plantar support surface 102*a* connecting the medial side wall 132, the lateral side wall 130, and the rear heel wall 134. The top plantar support surface 102*a* may constitute a layer of polymeric foam (optionally with one or more fluid-filled bladders contained therein) that extends downward from the top surface 102*a* by, for example, about 10-20 mm in the central heel area and/or by about 8-16 mm in the forefoot (e.g., metatarsal head support) area. The walls 130, 132, and 134 may extend upward from the top surface 102*a* and may be tapered or of varying height, e.g., from 0-5 mm at the forefoot area to 25-50 mm (or even more) at the rear heel area. At least some portions of the 4½ billows of the billows structure 120 may extend continuously around an exterior surface of the lateral side wall 130, the rear heel wall 134, and the medial side wall 132.

The size, number, shape, and/or other features of the billowed structure 120 may be selected to control the feel of the article of footwear. Typically, a deeper billow (i.e., a greater dimension from a wave crest to the bottom of an adjacent trough) will provide a more responsive feel (e.g., quicker return to original shape). The size, density, and/or hardness of the midsole component(s) 102 and/or the protective component(s) 104 also may be controlled so as to enable control over the feel of the sole structure 100 to a wearer's foot. The billows structure 120 of this illustrated example sole structure 100 extends continuously and uninterrupted from a medial midfoot or forefoot area of the midsole component 102 (see FIG. 1C) to a lateral midfoot or forefoot area of the midsole component 102 (see FIG. 1D). This specific overall billows structure 120 includes five billow outer ridges connected by four billow interstitial areas located between adjacent billow outer ridges of the five billow outer ridges.

The billows structures may take on a variety of forms without departing from this invention. For example, FIGS. 1B, 1C, 1E, and 1F show that the walls of the individual billows have a "stepped" configuration and the outermost ridge of each individual billow constitutes a relatively sharp corner. These are not requirements. As additional examples, if desired, the billows side walls may be smooth, straight, and/or curved. Additionally, the outermost edge or ridge of each billow may be made as a less sharp corner, smoothly curved, boxed off, etc., without departing from the invention. Also, while the billows structures may appear similar on the opposite interior side of walls 130, 132, and 134 (e.g., with the billow peaks "hollowed" out; e.g., see FIG. 9), in this illustrated example, the interior surfaces of walls 130, 132, and 134 are smooth (i.e., these billows are solid and not hollowed out).

Also, in this illustrated example sole structure 100, at the rear heel area of the midsole component 102, a highest billow outer ridge (the topmost billow ridge) is vertically separated from a lowest billow outer ridge (at the bottom) by a vertical distance of at least 1.5 inches when the sole structure 100 is oriented on a horizontal surface. Additionally or alternatively, in this sole structure 100, at the rear heel area of the midsole component 102, a central billow outer ridge (the third billow in this example) extends rearward a greatest distance when the sole structure 100 is oriented on the horizontal surface. These features can be best seen, for example, in FIGS. 1B and 1C.

Also, as best shown in FIGS. 1B, 1C, and 1F, an exposed outer edge of the protective component 104 of this example sole structure 100 includes a billows structure 140 that extends around a front toe area of the sole structure 100. This example billows structure 140 includes three billow outer ridges connected by two billow interstitial areas located between adjacent billow outer ridges of the three billow outer ridges. As shown, the billows structure 140 of the protective component 104 of this example sole structure 100 is not continuous with the billows structure 120 of the midsole component 102. Rather, the billows structure 140 of the protective component 104 is separated from the billows structure 120 of the midsole component 102 by transition areas 142, 144 provided at a lateral forefoot area and at a medial forefoot area, respectively, of the sole structure 100. The transition areas 142 and/or 144 may be made from the midsole component 102, the protective component 104, and/or another sole component. Also, the transition areas 142 and/or 144 may have any desired structure, including another billows structure, one or more raised ribs or other support components, etc.

The sole structure shown in FIGS. 1A through 1F has a billows configuration 120 in which at least some of the individual billows 122, 124 extend continuously and uninterrupted around the midsole component(s) 102 and/or the protective component(s) 104 from their lateral side end to their medial side end. This is not a requirement. Rather FIGS. 2A through 2F show a similar sole structure 200, having similar parts and construction to the sole structure 100 of FIGS. 1A through 1F, but with a different billows configuration.

For the sake of brevity, the similar parts between FIGS. 1A-1F and those in FIGS. 2A-2F, will not be described in detail in this specification. Rather, the discussion to follow will focus on the differences between the structures shown in FIGS. 2A-2F as compared to those shown in FIGS. 1A-1F. As those skilled in the art can understand, the parts not described in detail below with respect to FIGS. 2A-2F may have the same or similar structures and/or the same or similar features and/or options to those similar parts and structures described above with respect to FIGS. 1A-1F.

Figure 2A:
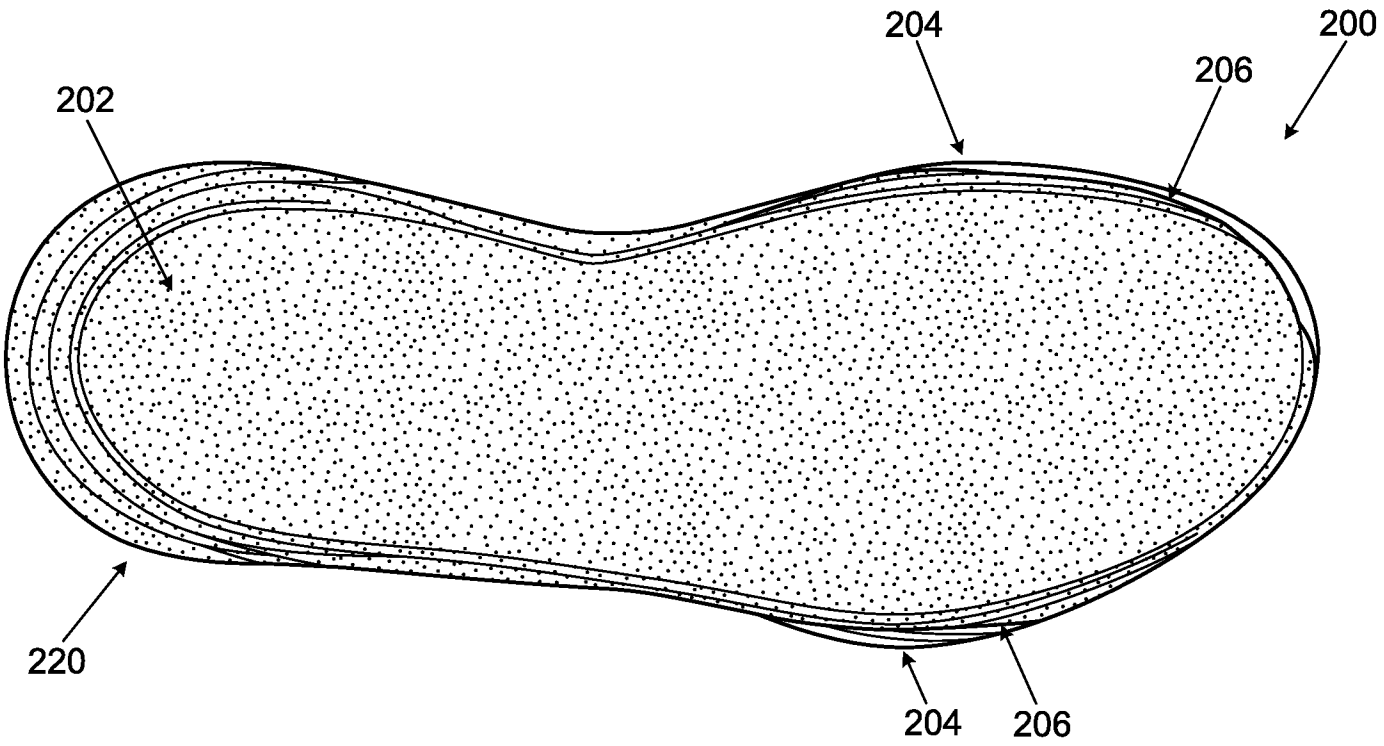
FIGS. 2A-2F illustrate a sole structure according to another example of this invention.
Figure 2B:
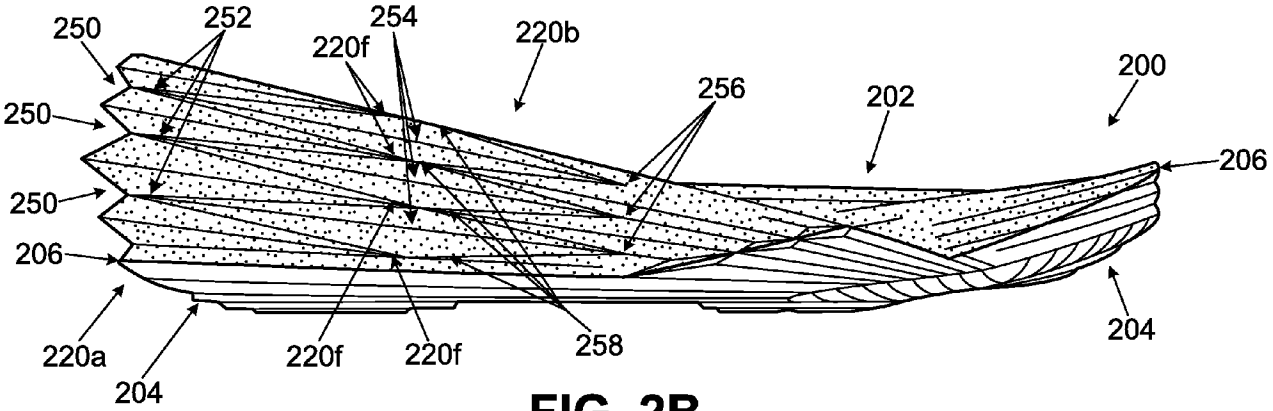

Unlike the billows configuration 120 shown in FIGS. 1A-1F, in which at least some of the individual billows 122, 124 extend continuously and uninterrupted around the midsole component(s) 102 and/or the protective component(s) 104 from their lateral side end to their medial side end, the billows configuration 220 of FIGS. 2A-2F includes intermixed or interwoven billows. As best seen from FIGS. 2B, 2C, and 2E, the billows configuration 220*a* at the rear heel area of this sole structure 200 has a similar billows construction as that in the rear heel area of the billows configuration 120 at the rear heel area of the sole structure 100 of FIGS. 1A-1F (e.g., with five billow outer ridges and four billow interstitial areas). However, as also best seen from FIGS. 2B, 2C, and 2E, the billows configuration 220 in this example sole structure 200 has a different configuration extending along and forward from the lateral heel and medial heel areas. More specifically, as illustrated in FIG. 2B, a new billows series 220*b* originates at the heel area within the interstitial areas 250 provided between the top three billows of the rear billows configuration 220*a*. The origins of the new billows of the new billows series 220*b* are shown in FIG. 2B at points 252 in interstitial areas 250. From their origin points 252, the three interstitial billows taper to larger widths and heights so as to form the outermost billow ridges to either side of their outer most points 254. Also, the interstitial billows of the new billows series 220*b* taper to a sufficiently large size so as to completely overtake the rear heel billows series 220*a* (note, for example, that the rear heel billows 220*a* have origin points 220*f* at locations within the interstitial areas of the new billows series 220*b*). Additionally, while not a requirement, in the example sole structure 200 shown in FIG. 2B, the outer ridges 254 of the new billows series 220*b* taper downward in size moving forward from their peak areas to end points 256. Other support structures, including another billows series configuration as shown in FIG. 2B, can originate from the interstitial areas between the new billows configuration 220*b* and/or from the outside of the new billows configuration 220*b* (e.g., from points 258) and moving forward in the sole structure 200. Thus, at least on the lateral heel side shown in FIG. 2B, the new billows series 220*b* may constitute a central billows configuration with a rearward billows configuration extending toward the heel (from origination points 220*f*) and a forward billows configuration extending to the midfoot area (from origination points 258).

Figure 2C:
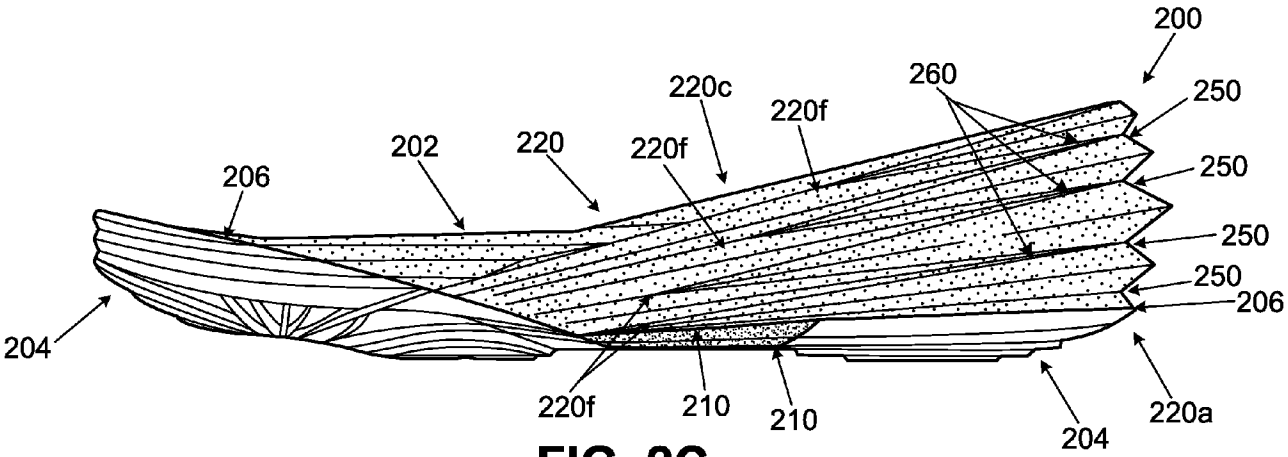

At the medial side of this sole structure 200, as illustrated in FIG. 2C, another new billows series 220*c* originates at the heel area within the interstitial areas 250 provided between the top three billows of the rear billows configuration 220*a*. The origins of the new billows of the new billows series 220*c* are shown in FIG. 2C at points 260 in interstitial areas 250. From their origin points 260, the three interstitial billows taper to larger widths and heights so as to completely overtake the rear heel billows series 220*a* (note, for example, that the rear heel billows 220*a* have origin points 220*f* at locations within the interstitial area of the new billows series 220*c*).

The example billows configuration of FIGS. 2A-2F shows different interstitial billows constructions on the medial side v. the lateral side. This is not a requirement. Rather, if desired, a billows configuration like that of FIG. 2B may be provided on the medial side and/or a billows configuration like that of FIG. 2C may be provided on the lateral side, without departing from the invention.

Figure 2D:
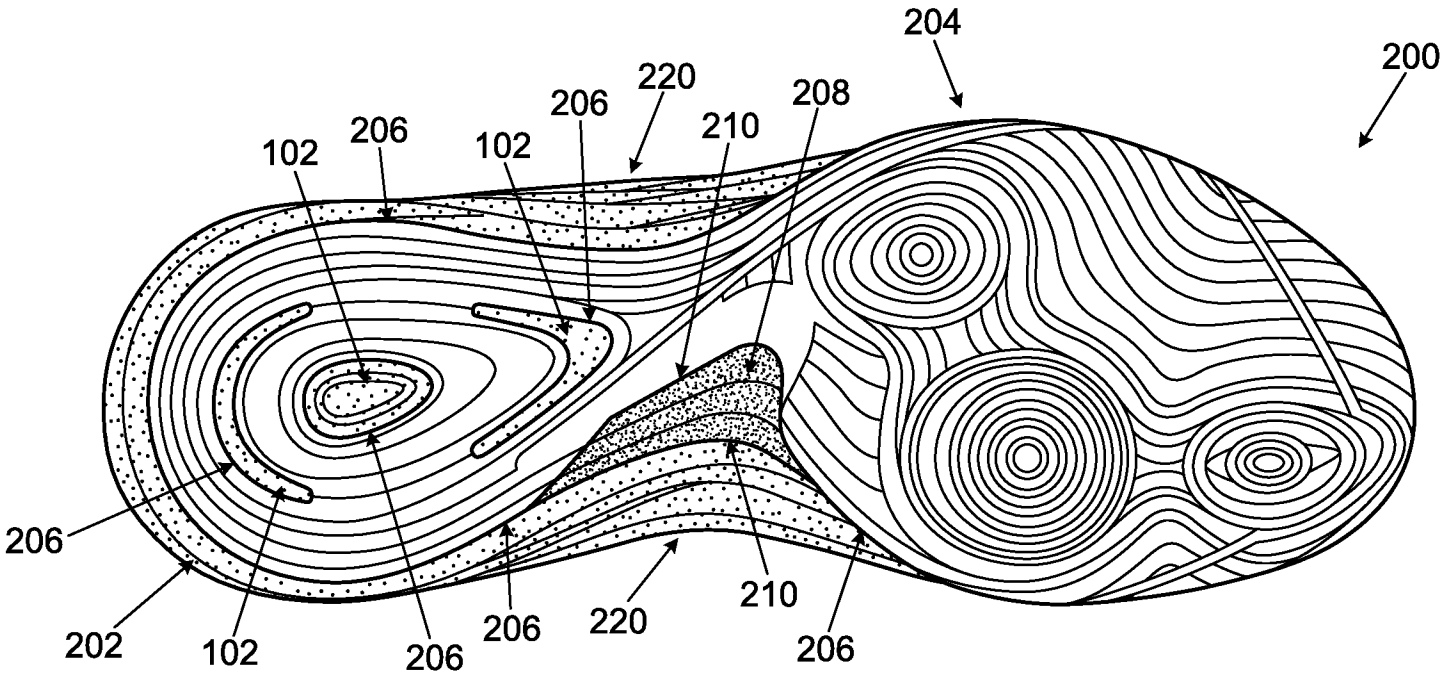
Figure 2F:
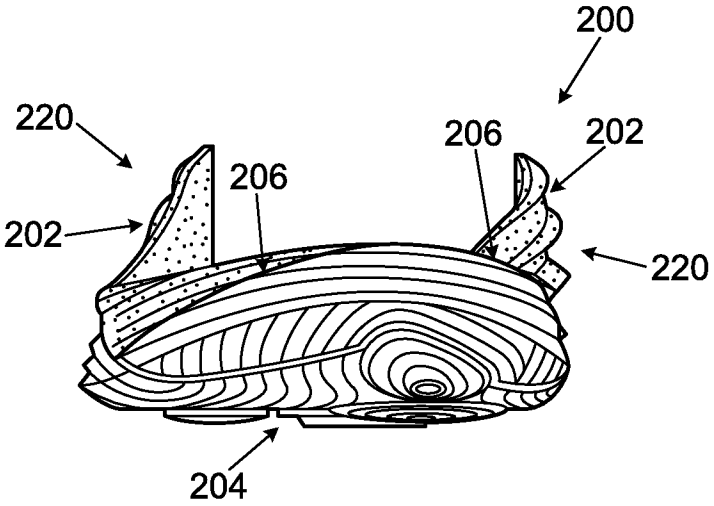
Figure 2E:
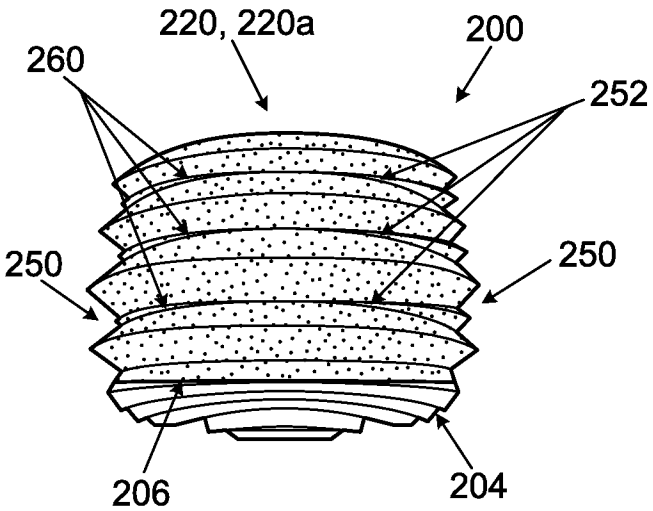

FIG. 2D further shows that this sole structure 200 has a somewhat differently configured bottom surface on the protective component 204 as compared to the bottom surface of the protective component 104 of sole structure 100 (shown in FIG. 1D). This leads to a different pattern of exposed midsole material 102 at the bottom surface of the sole structure 200. The junction areas 206 between the protective component 204 and the lightweight midsole material 202 are highlighted in FIGS. 2A-2F by broken lines. Also, the junction areas 210 between a midfoot support element 208 (e.g., akin to support element 108 of FIGS. 1A-1F) and the lightweight midsole material 202 and/or the protective component 204 are highlighted in FIGS. 2A-2F by broken lines. The bottom surface of the protective component 204 also includes traction elements and the like, as well as some features described in more detail below with respect to FIGS. 10A and 10B.

Figure 3A:
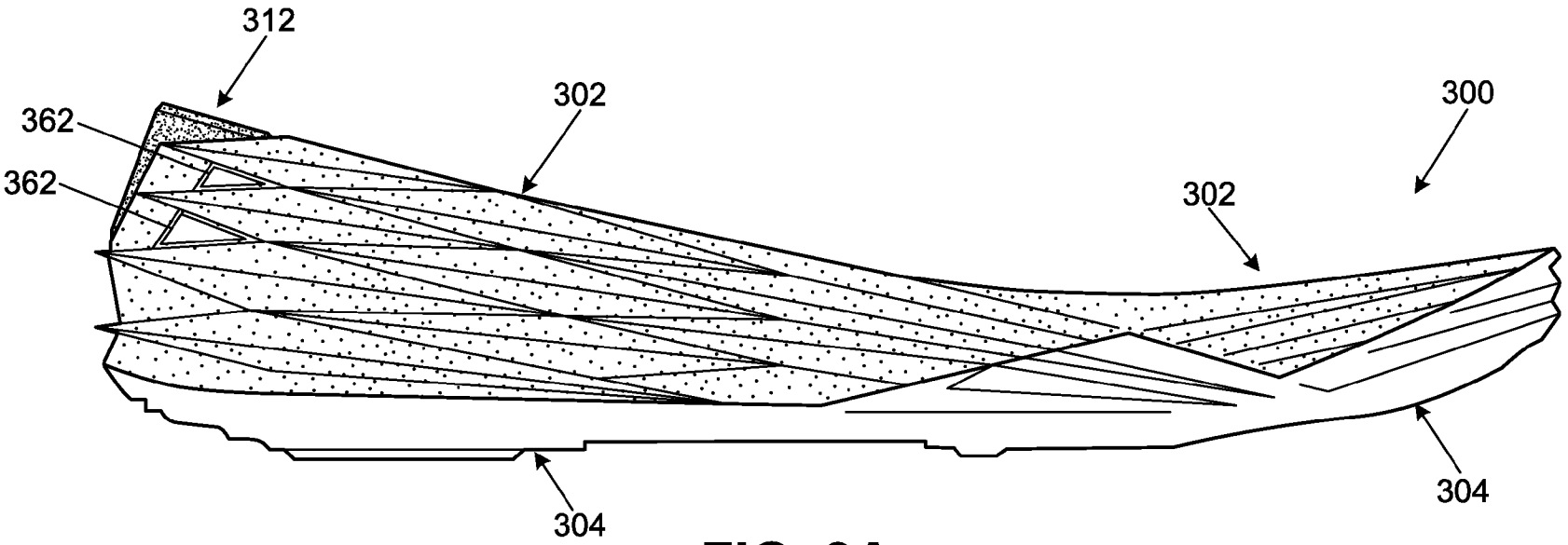
FIGS. 3A and 3B illustrate features of a sole structure according to another example of this invention.
Figure 3B:
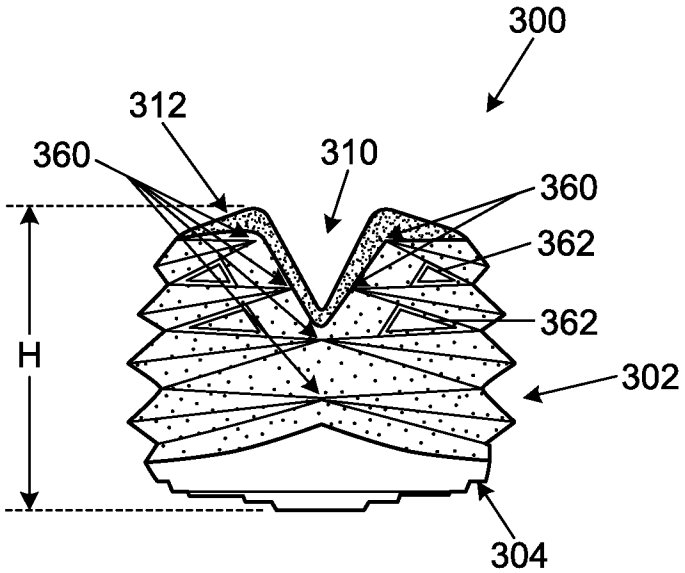

Another example alternative sole structure 300 in accordance with some examples of this invention is shown in conjunction with FIGS. 3A and 3B. Like the other sole structures 100, 200 described above, the sole structure 300 includes a lightweight foam midsole material 302 engaged, e.g., by adhesives or cements, with a protective component 304. The protective component 304, which may be made from a more dense or durable polymer foam and/or outsole material, provides at least a portion of the bottom surface of the sole structure 300. The sole structure 300 of FIGS. 3A and 3B may be generally similar in structure and function to the sole structure 200 shown in FIGS. 2A-2F, although other structures and functions are possible without departing from the invention. For the sake of brevity, the similar parts between FIGS. 2A-2F and those in FIGS. 3A-3B, will not be described in detail in the specification. Rather, the discussion to follow will focus on the differences between the structures shown in FIGS. 3A-3B as compared to those shown in FIGS. 2A-2F. As those skilled in the art can understand, the parts not described in detail below with respect to FIGS. 3A-3B may have the same or similar structures and/or the same or similar features and/or options to those similar parts and structures described above with respect to FIGS. 1A-2F.

In the example sole structures 100, 200 described above, the billows structure ran uninterrupted around the entire heel area of the lightweight midsole components 102, 202. This is not a requirement. Rather, as shown in FIGS. 3A and 3B, the rear heel area of this example lightweight midsole component 302 includes a cut out area 310 at its top side. This cut away area 310 may extend any desired vertical distance in the midsole component 302 without departing from the invention. As illustrated in FIG. 3B, in this example structure 300, the cut away area 310 extends down through at least two (and optionally more) of the individual billows structures, although other arrangements are possible without departing from the invention. The cut away area 310 also may extend downward from 25% to 65% of a total vertical height (H) of the sole structure 300 (and/or the midsole component 302) immediately adjacent the cut away areas 310. Also, while FIGS. 3A and 3B show the cut away area 310 only in the midsole component 302, the cut away area 310 also could be provided in the protective component 304, especially for sole structures in which the protective component 304 has a greater presence in the vertical dimension at the location of the cut away area 310.

The cut away area 310 of this example sole structure 300 is somewhat V-shaped so as to provide an open V-shaped area at the rear edge of the midsole component 302. Other shapes for the cut away area 310 are possible without departing from this invention, such as, U-shaped, rectangular or square shaped, circular shaped, star shaped, logo shape, and/or any other desired configuration. This example cutaway area 310 helps provide flexibility to the overall sole structure 300, and particularly to the midsole component 302, in the lateral side-to-medial side direction. This can provide a more natural motion or feel as a user engages in walking or other activities, such as running, landing a jump, or the like. Additional or other alternative cut away areas of these type may be provided at other locations around the sole structure 300 (i.e., not limited to the rear heel area). For example, cut away areas 310 along the lateral and/or medial sides of the sole structure 300 (e.g., in the forefoot area) may help provide and establish lines of flex for the sole structures (optionally to enhance the flexibility of the sole structure 300 to more closely correspond to natural foot flexion tendencies).

At the cut away area 310 of this example sole structure 300, the exposed edge of the foam midsole material 302 is covered by an edge element 312, e.g., a molded thermoplastic polyurethane member, another plastic member, etc. This edge element 312, formed as a heel clip, helps protect the exposed edges of the foam midsole material 302 and helps provide interesting anesthetic or design opportunities. Edge elements 312 of this type also allow one to change the shape of the cutaway area 310, if desired. The edge elements 312, when present, may be secured to the foam midsole component 302 and/or to another portion of the overall sole structure 300 and/or footwear structure in any desired manner without departing from the invention. As some more specific examples, these components may be engaged together using adhesives or cements, mechanical connectors, or the like. The edge element 312 also can be used to affect the flex or stiffness characteristics of the sole structure 300.

As further shown in FIG. 3B, some of the various billows areas of the foam midsole component 302 of this structure 300 have origination points 360 located at or near the edge of the cut away area 310. While the individual billows interrupted by the cutaway area 310 may have their origination points 360 at the edge of the cutaway area 310, in this illustrated example sole structure 300, additional billows areas located below the cut away area 310 also have their origination points 360 located at the rear heel area. Alternatively, if desired, the lower billows areas could extend continuously around the rear heel area uninterrupted (although optionally changing in size) without departing from the invention. Other billows configurations above and/or below the cut away area 310 also may used without departing from this invention.

While described above as a "cut away" area 312, this area 312 need not be provided in any part of the sole structure 300 by a cutting action. Rather, area 312 could be provided in the desired component(s) of the sole structure 300 in any desired manner without departing from the intervention, including through the use of a cutting action, e.g., by a laser, knife, blade, die, or other cutting system. Alternatively, the area 312 could be formed directly in the sole structure component (s) (e.g., components 302 and/or 304) during its manufacturing process, such as by being molded directly into the structure of foam midsole component 302 and/or a protective component 304. Therefore, the term "cut away area" as used herein in this context and/or for this type of component should be construed to include an area of this type of structure regardless of how the area is provided in the component.

FIGS. 3A and 3B also show that in this example structure 300, some of the areas between the billows at the rear heel area, adjacent the cut away area 310, have windows 362 that extend completely through the side wall of the midsole component 302. In the illustrated example 300, the windows 362 extend along edges of the billows located above and below them (as the billows taper to their origination points 360), although other shapes for the windows 362 may be used without departing from the invention. The windows 362 may affect the flexibility of the midsole component 302 at the rear heel area of this example sole structure 300. More or fewer windows 362 may be provided in the sole structure 300 without departing from the invention, including more or less windows 362 on either side of the cut away area 310 (including no windows 362 on one or both sides).

The windows 362 may be provided in the desired component(s) of the sole structure 300 in any desired manner without departing from the intervention, including through the use of a cutting action (e.g., by a laser, knife, blade, die, or other cutting system), by integrally forming the windows 362 directly in the sole structure component(s) (e.g., components 302 and/or 304) during its manufacturing process (such as by molding the windows 362 directly into the structure of foam midsole component 302 and/or a protective component 304), etc.

Figure 4:
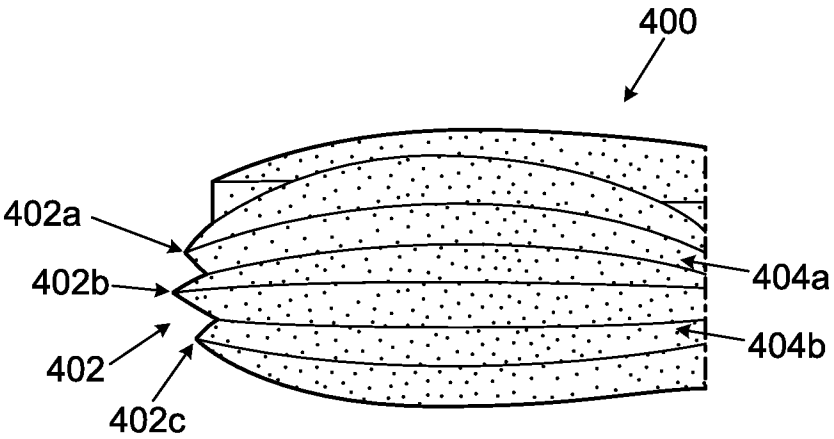
FIG. 4 illustrates a heel area of a portion of a foam component that may be included in sole structures in accordance with some examples of this invention.

While the sole structures 100, 200, 300 of FIGS. 1A through 3B all show billows structures having three to five individual billows structures over various areas that are relatively uniformly shaped, this is not a requirement. As another example, FIG. 4 illustrates a portion of another example sole component 400 in which the billows structure 402 includes three billows oriented in the vertical or top-to-bottom direction. The view of FIG. 4 shows a lateral side view of this example billow structure 402, but a similar structure could be provided, for example, on the medial side of the sole component 400 and/or at the rear heel area of the sole component 400. This example billow structure 402 may be provided in a foam midsole component as illustrated in FIG. 4 (e.g., akin to components 102, 202, and/or 302 discussed above), or it may be provided in a protective component, such as polymeric foam protective component and/or components like components 104, 204, 304 discussed above in conjunction with FIGS. 1A through 3B. Also, while only the heel area of the sole component 400 is shown in FIG. 4, those skilled in the art, given the benefit of this disclosure, would readily understand that a sole component for supporting an entire plantar surface of a wearer's foot (or any portion thereof) could be provided, without departing from this invention.

The billows structure 402 of FIG. 4 differs from some of the other billows structures described above with respect to FIGS. 1A-3B in the shape of the billows. More specifically, as shown in FIG. 4, the central billows 402*b* of this example billows structure 402 is concave (or expands outward) both in the upward and downward directions. As shown in FIG. 4, the bottom valley of the interstitial area 404*a* between the central billows 402*b* and the top billows 402*a* curves in a concave upward direction so that the high point of that curve is at the central side heel area. Similarly, the bottom valley of the interstitial area 404*b* between the central billows 402*b* and the bottom billows 402*c* curves in a concave downward direction so that the low point of that curve is at the central side heel area. Because of this configuration, the top billows 402*a* is shaped to curve in an upward direction with the upper maximum point of that curve located in the central area of the top billows 402*a* in the arrangement shown in FIG. 4. Similarly, the bottoms billows 402*c* is shaped so as to curve in a downward direction with the lower minimum point of that curve located in the central area of the bottom billows 402*c* in the arrangement shown in FIG. 4. This gives the overall billow structure 402 somewhat of a more bulbous shape as compared to at least some of the billow structures shown in FIGS. 1A through 3B.

Notably, the billows construction 402 has smoother side walls (as do the billows structures of FIGS. 2A-3B) as compared to the more stepped side walls in the billows structures shown in FIGS. 1A-1F. Also, the billows constructions of FIGS. 2A-4 have outer ridges of the individual billows formed as sharp corners. Other structural options for these side walls and/or corners are possible, however, without departing from this invention.

Figure 5:
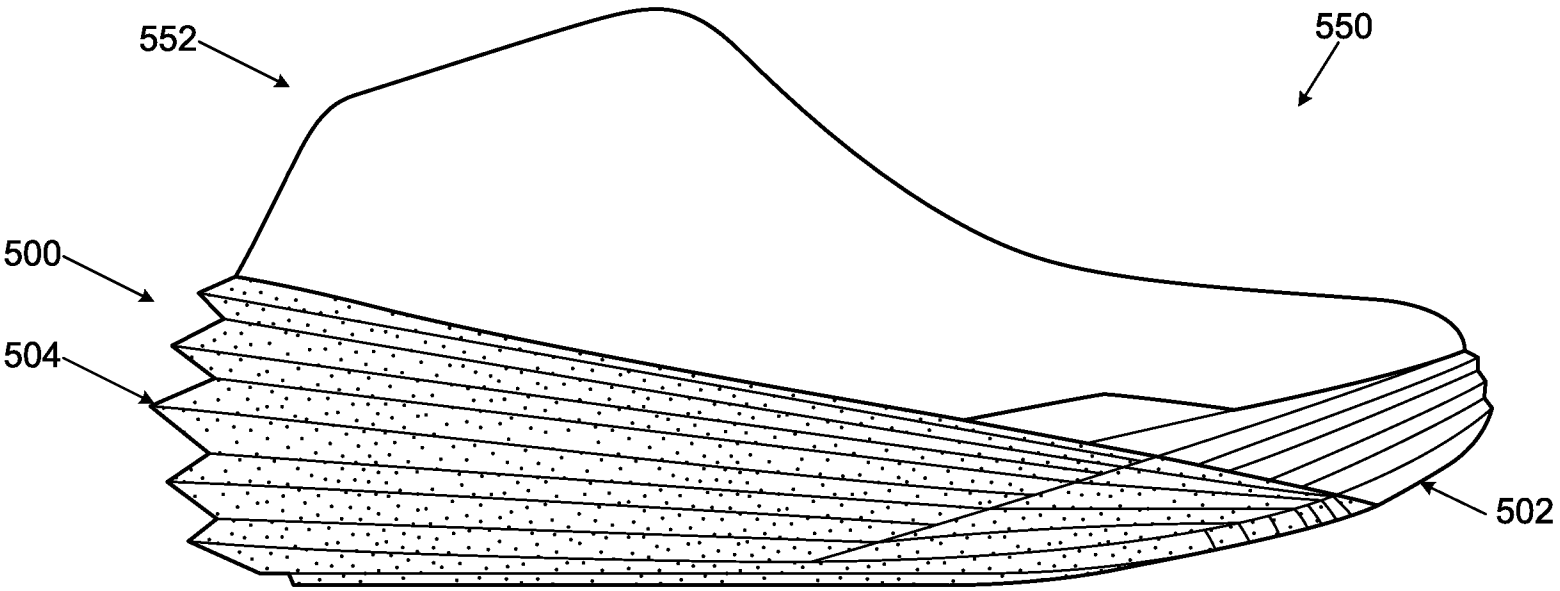
FIG. 5 illustrates a basketball shoe according to one example of this invention.
Figure 6:
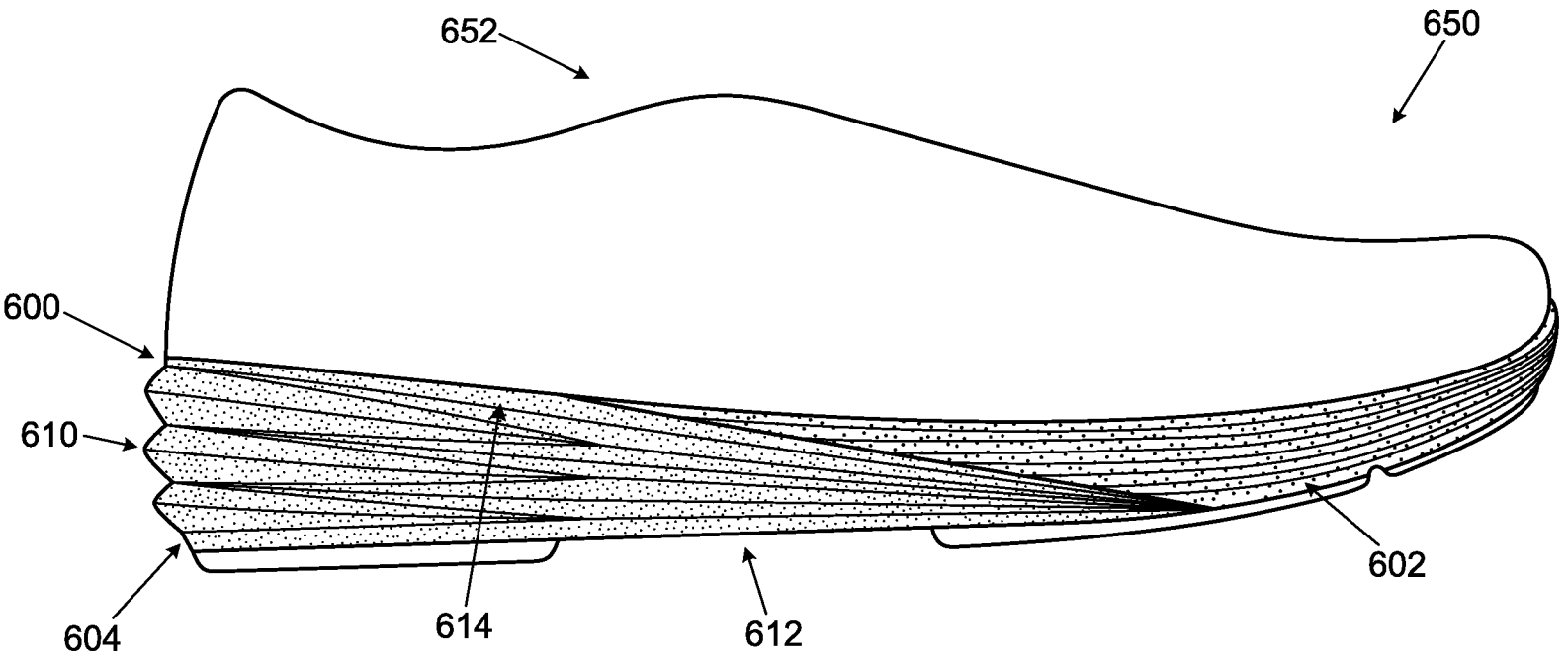
FIG. 6 illustrates a running shoe according to one example of this invention.
Figure 7:
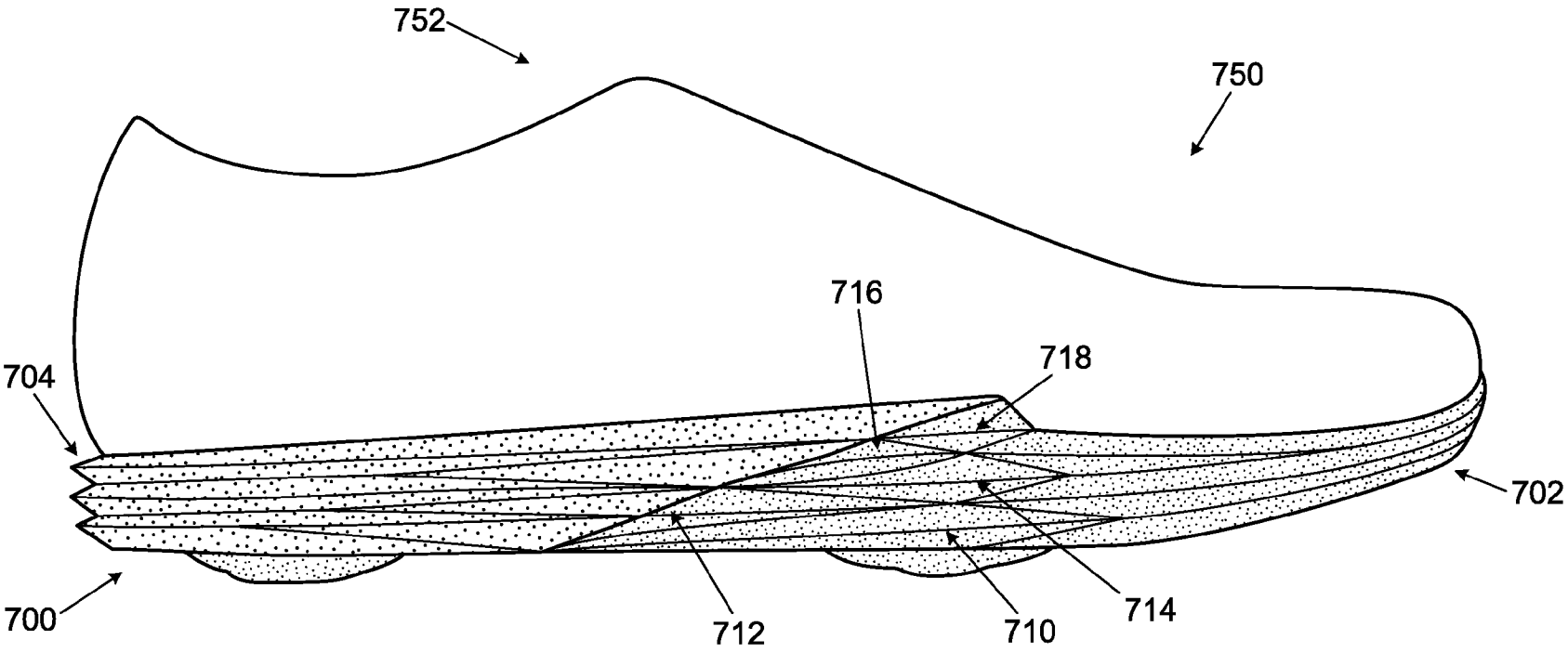
FIG. 7 illustrates a training shoe according to one example of this invention.

FIGS. 5, 6, and 7 show side views of various different examples of articles of footwear 550, 650, and 750 that include sole structures 500, 600, and 700 in accordance with other examples of this invention. FIG. 5 illustrates a basketball shoe 650, FIG. 6 illustrates a running shoe 650, and FIG. 7 illustrates a cross training shoe 750. The sole structures 500, 600, and 700 are engaged with uppers 552, 652, and 752, respectively, to provide the overall footwear structures 550, 650, and 750. The uppers 552, 652, and 752 may be engaged with their respective sole structures 500, 600, and 700 in any desired manner without departing from this invention, including in conventional manners as are known and used in this art. As some more specific examples, the uppers 552, 652, and 752 and the sole structures 500, 600, and 700 may be engaged together by adhesives or cement, by mechanical connectors, by stitching or sewing, and/or by other connection techniques.

In further describing the footwear structures 500, 600, and 700 of FIGS. 5-7, various features of example uppers (including potential features of uppers 552, 652, and 752) will be described. This description includes examples of features of uppers that may be included in footwear structures in accordance with at least some examples of this invention, including examples of uppers that may be engaged with the sole structures 100, 200, 300, and 400 of FIGS. 1A-4. Because the sole structures 500, 600, and 700 of FIGS. 5-7 have generally similar structures, some differences between these sole structures 500, 600, and 700 will be described in conjunction with FIGS. 5-7. Thereafter, more detailed features of the construction and parts of the sole structures 500, 600, and 700 of FIGS. 5-7 will be described in more detail in conjunction with FIGS. 8A-8F.

The uppers 552, 652, and 752 for article of footwear structures 550, 650, and 750 in accordance with this invention may constitute one or multiple component part constructions that may be engaged together in any desired manner, including in conventional manners as are known and used in the footwear art, including through the use of cements or adhesives, through the use of mechanical connectors, and/or through fusing techniques (e.g., melt or fuse bonding of a hot melt material, etc.). Non-limiting examples of some construction techniques will be described in more detail below.

The upper 552, 652, 752 may be made from any desired materials and/or combinations of materials without departing from this invention. For example, the upper 552, 652, 752 may include a multi-layered construction, with the various layers covering all or some portion of the overall upper area. In some more specific examples, the upper 552, 652, 752 may include an intermediate mesh layer covered and/or sandwiched in at least some areas by an interior fabric or textile layer (e.g., for comfortable contact with the foot) and an exterior "skin" layer (e.g., made from a thermoplastic polyurethane film, to provide better support at certain areas, to provide wear or abrasion resistance in certain areas, to provide desired aesthetics, etc.). None of the interior fabric or textile layer, the mesh layer, and/or the skin layer needs to extend to cover an entire surface of the upper 552, 652, 752. Rather, the location(s) of the various layers may be selected to control the properties of the upper 552, 652, 752, e.g., by omitting the skin layer at certain areas to improve breathability, to improve flexibility, to provide a different aesthetic appearance (such as openings in the skin layer to produce a "LOGO" or other design feature from the underlying mesh material), etc. Also, as is known in the art, the upper 552, 652, 752 may define an ankle opening, around which a comfort-enhancing foam or fabric ring may be provided, if desired. The bottom surface of the upper 552, 652, 752 may include an interior strobel member that connects the medial and lateral sides of the upper material (e.g., the strobel member may be sewn to the medial and lateral side edges of the upper) to thereby close off the upper 552, 652, 752. The sole structure 500, 600, 700 may be engaged with the upper 552, 652, 752 at its bottom edges and the strobel, e.g., using cements or adhesives, stitching or sewing, mechanical connectors, etc.

The multi-layered upper construction may be produced in any desired manner without departing from this invention, including in conventional manners as are known and used in the footwear art. For example, if desired, the skin layer may be made from a "no-sew" type material that may be adhered to the underlying mesh layer (or other layer) using an adhesive or hot melt material in a conventional manner, e.g., by application of heat and/or pressure. As additional examples, if desired, the skin layer may be engaged with the underlying mesh layer (or other layer) by cements or adhesives and/or by sewn seams. As yet additional examples, if desired, the upper 552, 652, 752 (or portions thereof) may be constructed by bonding various layers of materials using fusing techniques, e.g., as described in U.S. Patent Application Publication No. 2011/0088282 and U.S. Patent Application Publication No. 2011/0088285, each of which is entirely incorporated herein by reference.

The upper 552, 652, 752 may include other support elements at desired locations, e.g., sandwiched between the exterior skin layer and the underlying mesh layer. For example, a heel counter may be provided in the heel area to provide more support for the wearer's heel. The heel counter, when present, may be made from a rigid, thin plastic material, such as PEBAX®, TPU, or other polymeric material, and it may include one or more openings (e.g., to control flexibility, breathability, support characteristics; to reduce weight; etc.). If necessary or desired, additional supports may be provided in other areas of the shoe 550, 650, 750, such as in the forefoot or toe area (to provide protection and wear resistance, etc.), at the lateral side area near the fifth metatarsal head, etc.

Other potential materials that may be used in uppers 552, 652, 752 in accordance with at least some examples of this invention include one or more of: synthetic leather, natural leather, textiles, any combination of these materials, and/or any combinations of these materials with any of the other materials described above. As another potential feature, if desired, at least some portion of the upper 552, 652, 752 may be formed by a knitting procedure. Optionally, at least a majority (or even all) of the upper 552, 652, 752 may be formed using knitting procedures, in at least some examples of this invention. Knitted textile components can be used to provide lightweight, breathable, and comfortable upper constructions.

Returning now to FIG. 5, additional details of this example footwear structure 550 will be described. This example footwear structure 550 is a basketball shoe. The upper 552 may have a construction like that of any conventional basketball shoe, including constructions made from leathers, multi-layered fuse-bonded materials, or other materials and/or constructions as are known and used in the art. The sole structure 500 of this example has a similar general appearance to the sole structure 100 shown in FIGS. 1A through 1F as described in detail above, e.g., including a series of five stacked billows extending continuously around the sole structure 500 from the forefoot lateral side area, around the rear heel area, to the forefoot medial side area of the sole structure 500. The five billow construction of this example sole structure 500 is well suited for a basketball shoe because it creates a somewhat taller heel structure, as is common in modern day basketball shoes.

While similar in billows appearance, however, the sole structure 500 of FIG. 5 differs considerably in construction from the sole structure 100 of FIGS. 1A-1F. While a detailed description of the construction of this sole structure 500 will be saved for the discussion of FIGS. 8A-8F below, at this juncture it is adequate to say that the exposed rear portion 504 of the sole structure 500 constitutes a protective element that at least partially holds and contains a portion of midsole component 502. The rear protective component 504 may be made from materials like the various protective components 104, 204, 304 described above (e.g., including a polymeric foam material with one or more billows structures formed on its outside wall edge). The forward portion 502 of sole structure 500 in this example constitutes an exposed portion of a lightweight foam midsole material 502, which may be akin to the lightweight midsole components 102, 202, 302, as described above (including the same or similar materials). While the midsole component 502 may still extend to support all or substantially all of the plantar surface of a wearer's foot, in this illustrated example structure 500, at least some, and optionally a majority, of the lightweight midsole component 502 is contained within the protective component 504. In this manner, at the rear of the footwear structure 550, the protective component 504 acts as a cage or carrier for the lightweight foam component 502. The foam midsole component 502 extends out of the forward (open) end of the protective component 504, as will be described in more detail below.

Turning now to FIG. 6, additional details of this example footwear structure 650 will be described. This example footwear structure 650 is a running shoe. The upper 652 may have a construction like that of any conventional running shoe, including constructions made from multi-layer fuse-bonded materials, textiles, meshes, knit materials, or other materials and/or constructions as are known and used in the art. The sole structure 600 of this example has a similar general appearance to the sole structure 200 shown in FIGS. 2A through 2F as described in detail above, e.g., including a first series of stacked billows 610 extending around the rear heel area of the sole structure 600 and a staggered, forward series of billows 612 extending forward from the heel area toward the midfoot and forefoot areas of the sole structure 600. The forward series of billows 612 originate in the interstitial areas between billows of the rear heel billows series 610. The top billow of the forward series of billows 612 originates above the top billow of the rear heel billows series 610. The rear heel series of billows 610 terminate in the heel to midfoot area, e.g., in interstitial areas between or along individual billows of the forward series of billows 612. While FIG. 6 shows only the lateral side view, the medial side view may have a similar interstitial billows configuration.

The sole structure 600 for this running shoe 650 example is somewhat shorter and more low profile than the sole structure 200 of FIGS. 2A-2F and the sole structure 500 of FIG. 5. Notably, the sole structure 600 includes three vertically stacked billows 610 at the rear heel area (instead of the five billows shown in FIGS. 2A-2F) and three vertically stacked forward billows 612 staggered from the heel billows 610. While it would not be required, this reduced number of billows provides somewhat less vertical height in the heel area of the sole structure 600.

Also, like the sole structure 500 of FIG. 5, the exposed rear portion 604 of the sole structure 600 constitutes a protective element that at least partially holds and contains a portion of a lightweight foam midsole component 602. The rear protective component 604 may be made from materials like the various protective components 104, 204, 304 described above (e.g., including a polymeric foam material with one or more billows structures formed on its outside wall edge). The forward portion 602 of sole structure 600 in this example constitutes an exposed portion of a lightweight foam midsole material 602, which may be akin to the lightweight midsole components 102, 202, 302, as described above (including the same or similar materials). While the midsole component 602 may still extend to support all or substantially all of the plantar surface of a wearer's foot, in this example structure 600, at least some, and optionally a majority, of the lightweight midsole component 602 is contained within the protective component 604. In this manner, at the rear of the footwear structure 650, the protective component 604 acts as a cage or carrier for the lightweight foam midsole component 602. The foam midsole component 602 extends out of the forward (open) end of the protective component 604 as will be described in more detail below.

With respect to the vertical direction shown in FIG. 6 (e.g., with the shoe 650 oriented on a horizontal contact surface), the heel and/or midfoot area includes interwoven billows from the rear heel billows series 610 and the forward series of billows 612. In other words, as one moves in the vertical direction in at least some portions of the heel and/or midfoot area of the sole structure 600 (e.g., shown by line 614), one will encounter surfaces of individual billows of the forward series of billows 612 located between surfaces of individual billows of the rear heel series of billows 610. These stacked and/or interwoven series of billows provide added support in this heel/midfoot area and provide good support for a running shoe sole.

FIG. 7 illustrates a training shoe 750. The upper 752 may have a construction like that of any conventional training shoe, including constructions made from fuse-bonded materials, textiles, meshes, knit materials, or other materials and/or constructions as are known and used in the art. The sole structure 700 of this example has a configuration with interstitial billows as will be described in more detail below Like the sole structure 500 of FIG. 5, the exposed rear portion 704 of the sole structure 700 constitutes a protective element that at least partially holds and contains a portion of midsole component 702. The rear protective component 704 may be made from materials like the various protective components 104, 204, 304 described above (e.g., including a polymeric foam material with billows structures formed on its outside wall edge). The forward portion 702 of sole structure 700 in this example constitutes an exposed portion of a lightweight foam midsole material 702, which may be akin to the lightweight midsole components 102, 202, 302, as described above (including the same or similar materials). While the midsole component 702 may still extend to support all or substantially all of the plantar surface of a wearer's foot, in this example structure 700, at least some, and optionally a majority, of the lightweight midsole component 702 is contained within the protective component 704. In this manner, at the rear of the footwear structure 750, the protective component 704 acts as a cage or carrier for the lightweight foam midsole component 702. The foam midsole component 702 extends out of the forward (open) end of the protective component 704 as will be described in more detail below.

In this example sole structure 700, both the rear heel area of the protective component 704 and the forward toe area of the midsole foam component 702 include a vertically stacked three billows structure (with the heel billows somewhat deeper than the forefoot billows). Various different types of support features are provided, however, in the midfoot to forefoot area, at least along the lateral side of the shoe 750 (although similar structures could be provided on the medial side, if desired). Moving in the vertical direction in FIG. 7, a first support rib or element 710 is provided along the bottom of the lateral side of the sole structure 700 (in the foam midsole component 702, in this example). This first support rib or element 710 is located vertically downward from and proximate to a fifth metatarsal head support area of the sole structure 700. A second support rib or element 712 is provided somewhat rearward and upward from the first support rib or element 710. This second support rib or element 712 bridges the junction between the foam midsole component 702 and the protective component 704 in this example structure 700 and peaks more in the midfoot or arch region of the sole structure 700. The second support rib or element 712 may have an overall longer longitudinal dimension from end-to-end than that of the first support rib or element 710. A third support rib or element 714 is provided somewhat forward and upward from the second support rib or element 712. At least a majority (and potentially all) of this third support rib or element 714 is formed in the foam midsole component 702. The third support rib or element 714 vertically overlaps the first support rib or element 710 and is located vertically downward from and proximate to the fifth metatarsal head support area of the sole structure 700. This third support rib or element 714 may have a shorter longitudinal dimension (end-to-end) than the first support rib or element 710. A fourth support rib or element 716 is provided somewhat rearward and upward from the third support rib or element 714. This fourth support rib or element 716 also bridges the junction between the foam midsole component 702 and the protective component 704, but a majority of it is located in the midsole component 702 and forward of the second support rib or element 712. A fifth support rib or element 718 is provided somewhat forward and upward from the fourth support rib or element 716. At least a majority (and potentially all) of this fifth support rib or element 718 is formed in the foam midsole component 702. The fifth support rib or element 718 vertically overlaps the first support rib or element 710 and the third support rib or element 714, and it is located proximate to the fifth metatarsal head support area of the sole structure 700. The fifth support rib or element 718 may have a shorter longitudinal dimension than the first support rib or element 710 and/or the third support rib or element 714.

Accordingly, the first support rib or element 710, second support rib or element 712, third support rib or element 714, fourth support rib or element 716, and fifth support rib or element 718 produce a discontinuity in the billows structures between the billows structures in the rear heel protective component 704 and the forward foam midsole component 702. These support ribs or elements 710, 712, 714, 716, and/or 718 provide additional support for the lateral midfoot and/or forefoot areas of this sole structure 700, e.g., in the area near the fifth metatarsal head of the wearer's foot. This provides additional support for the wearer during training activities, such as when pushing off the outside of the foot, e.g., when making a sharp turn or cut action.

While other specific structures are possible, in this illustrated example, the support rib or elements 710, 712, 714, 716, 718 are shaped as raised pyramid-like structures that extend outward from the side surface of the sole structure 700. The support ribs or elements 710, 712, 714, 716, 718 may be oriented somewhat like the interwoven billows structures that are shown in various other figures described above. More specifically, as shown in FIG. 7, the support ribs or elements 712 and 716 originate in interstitial areas between the support ribs or elements 710, 714, and 718. The support ribs or elements 710, 712, 714, 716, 718 also may originate in interstitial areas between billows located forward and/or rearward of the support rib or element. Notably, the outward extending peaks of support ribs or elements 712, 716, and 718 substantially align in a top forward-to-bottom rearward direction. Also, the outward extending peaks of support ribs or elements 710, 714, and 718 substantially align in a vertical direction from top to bottom.

The support rib or element structures of FIG. 7 constitute merely examples of structures for providing lateral and/or medial side support (and/or for altering or controlling support features of the sole 700). Other support changing configurations, including different numbers of ribs, different arrangements of ribs, different shapes of ribs, and/or different relative orientation of the ribs with respect to one another may be used without departing from this invention. Also, if desired, simple gaps between adjacent billows structures could be provided, e.g., to change the support or feel at the gaps. The "gaps" may include actual spacings in the foam material or smooth foam material between billows structures.

Figure 8A:
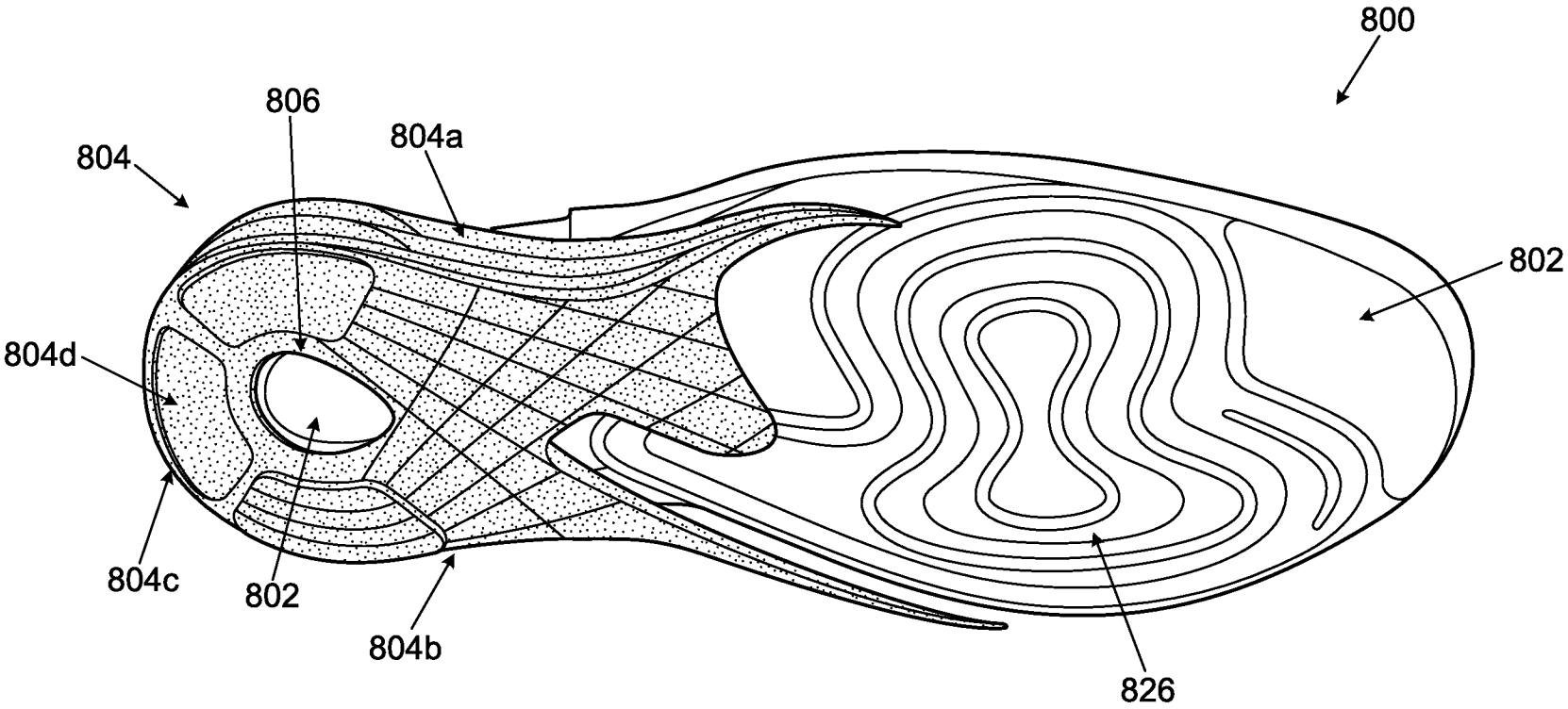
FIGS. 8A-8F illustrate a sole structure according to another example of this invention.
Figure 8B:
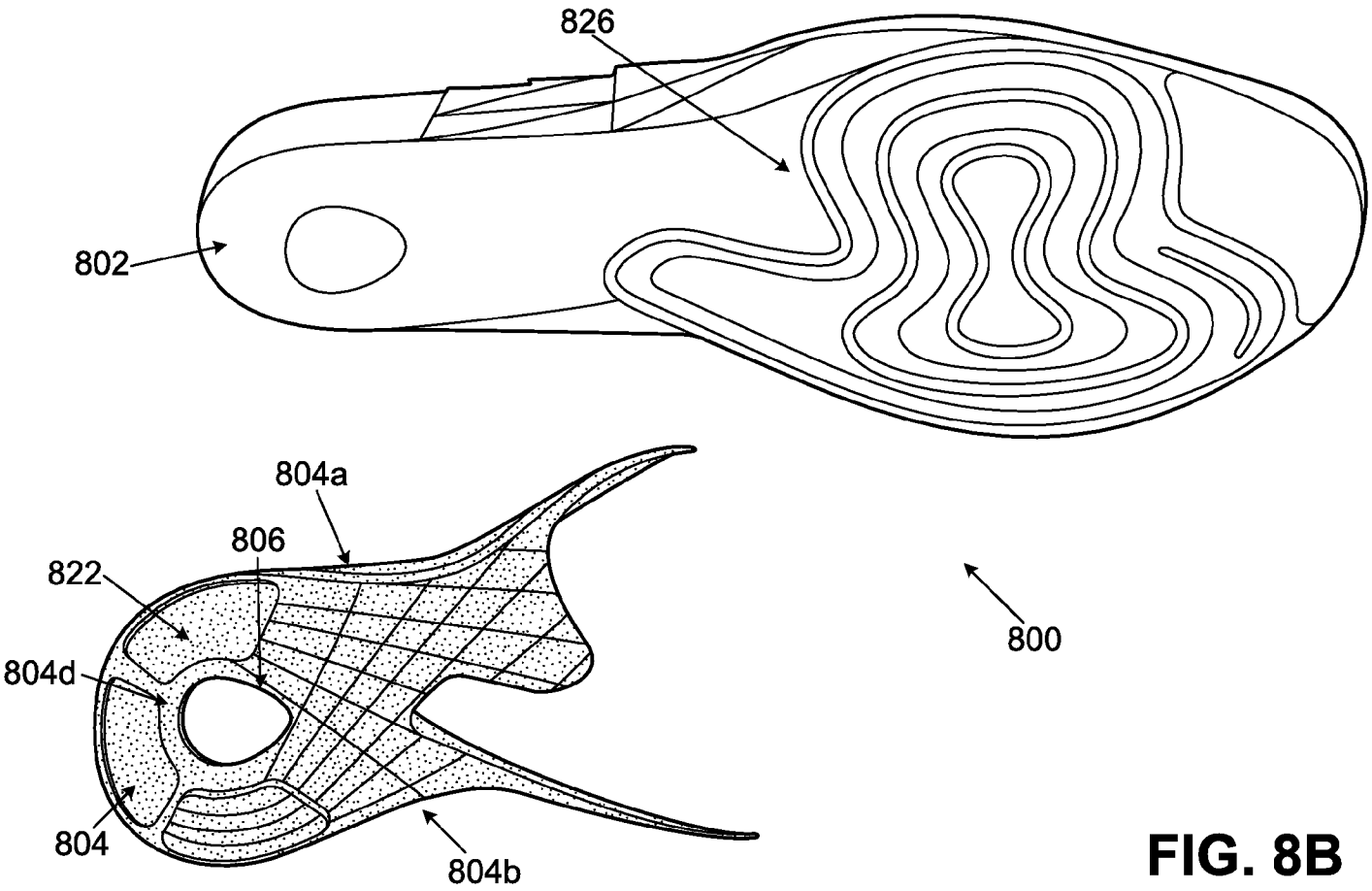
Figure 8C:
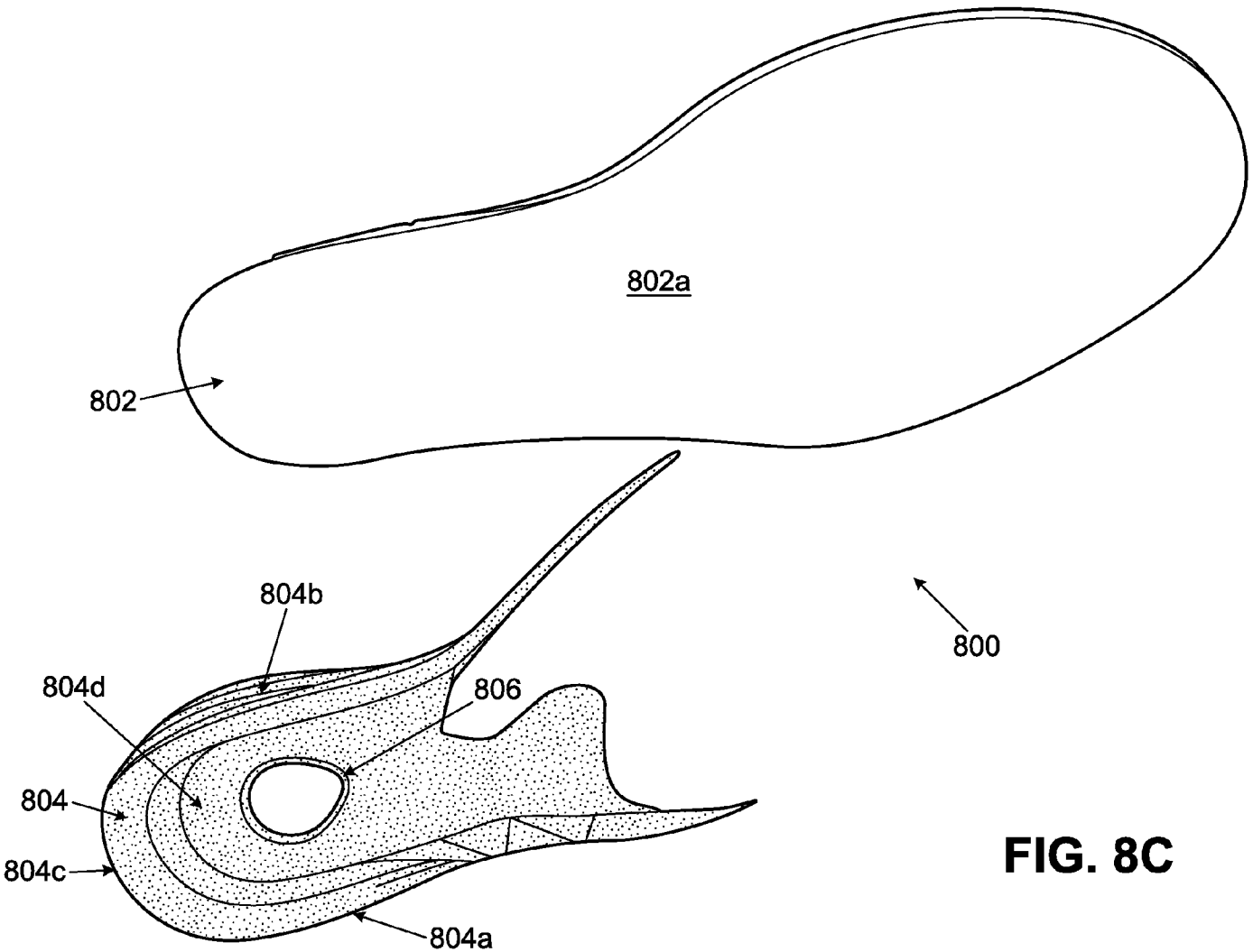

One example construction of the sole structures 500, 600, and 700 of FIGS. 5 to 7 is described in more detail in conjunction with FIGS. 8A through 8F. FIG. 8A shows a bottom perspective view of an example sole structure 800 including a rear protective component 804 and a foam midsole component 802 extending forward and out of the free end of the protective component 804. FIG. 8A shows the protective component 804 and the foam component 802 fit together, but prior to being secured to one another, for example, using adhesives or cements. FIG. 8B shows bottom views of these two parts separated from one another, and FIG. 8C shows top views of these two parts separated from one another. As can be seen from these figures, the protective component 804 acts as a cage or carrier that contains the rear part of the foam midsole component 802. The foam midsole component 802 has an upper support surface 802*a* for supporting all or substantially all of a plantar surface of a wearer's foot (although if desired, the protective component 804 also could provide a surface for directly supporting at least some portion of a plantar surface of a wearer's foot). In addition to extending out the free, forward end of the protective component 804, the foam midsole component 802 is exposed through a heel opening 806 defined in the bottom surface of the protective component 804. Providing this bottom opening 806 can both lighten the weight and allow one to control and alter the flexibility characteristics of the overall sole structure 800.

In this example structure 800, the foam midsole component 802 may be made from any desired foam material (or combinations of foam materials) without departing from this invention, including lightweight foam materials of the types described above in conjunction with components 102, 202, 302. Optionally, if desired, the foam midsole component 802 may include one or more fluid filled bladders, mechanical shock absorbing structures, and/or other structures for providing impact force attenuation embedded or included therein. In this illustrated example, however, the foam midsole component 802 constitutes a single, solid piece of foam material, preferably one of the lightweight and/or less dense foam materials described above.

The protective component 804 of this illustrated example sole structure 800 also may constitute a polymeric foam material, including conventional polymeric foam materials as are known and used as midsole materials in the footwear art. As some more specific examples, the protective component 804 may be made from polyurethane foam, ethylvinylacetate ("EVA") foams, phylon, or other known midsole foams or materials. In some examples structures in accordance with this invention, the polymeric foam material used for the protective component 804 will be a heavier, more dense, and/or more durable foam material (e.g., more wear resistant, more abrasion resistant, etc.) than the foam material used in the foam midsole component 802.

As further shown in FIGS. 8A-8C, the polymeric foam material of the protective component 804 may include billows structures formed around at least portion(s) of its perimeter edge. More specifically, FIGS. 8A-8C show that the protective component 804 may constitute an outer shell including the billows structure (like those of FIGS. 5-7), wherein the outer shell includes: a lateral side wall 804*a*; a medial side wall 804*b*; a rear heel wall 804*c* connecting the medial side wall 804*b* and the lateral side wall 804*a*; and a bottom wall 804*d* connecting the medial side wall 804*b*, the lateral side wall 804*a*, and the rear heel wall 804*c*. In at least some examples of this invention, the billows structure of the polymeric foam material of the protective component 804 will extend continuously around an exterior surface of at least a portion of the lateral side wall 804*a*, the rear heel wall 804*c*, and at least a portion of the medial side wall 804*b*. The billows structure of the polymeric foam material of the protective component 804 also may include interwoven billows, support ribs or elements, vertical ribs, gaps, and/or any of the other billows structures, features, and/or options described above.

FIGS. 8A-8C further show that at least a heel portion of the foam midsole component 802 is received in a space defined between the lateral side wall 804*a*, the medial side wall 804*b*, the rear heel wall 804*c*, and the bottom wall 804*d* of the protective component 804. A forefoot end of foam midsole component 802 extends beyond a forward end of the lateral side wall 804*a* and a forward end of the medial side wall 804*b* in this example structure 800. This forefoot end of foam midsole component 802 may be at least partially exposed in the finished sole structure 800.

As described above at least with respect to FIG. 7, both the exterior side edge surface of the protective component 804 and the exterior side edge surface of the foam midsole component 802 may include billows structures. For example, the billows structure of the protective component 804 may extend (continuously or discontinuously (e.g., due to interwoven billows, other supports, and/or other features)) around a lateral side-to-rear heel-to-medial side of the sole structure. Additionally or alternatively, the foam midsole component 802 may include a billows structure that extends around a front toe area of the sole structure 800. In this specific illustrated example, the billows structure of the foam midsole component 802 includes three billow outer ridges connected by two billow interstitial areas.

When both components 802 and 804 have billows structures, the billows structure of the foam midsole component 802 may or may not extend continuous with the billows structure of the protective component 804. These billows structures may be interrupted, e.g., by support ribs or other elements, by interstitial billows, by gaps in the sole structure, by smooth foam material, by external plastic or composite supports, by transition areas, or the like, without departing from the invention. Such "interruptions" in the billows structures may be provided at any desired locations, such as at a lateral forefoot area of the sole structure and at a medial forefoot area of the sole structure (e.g., to provide locations that support more natural motion flex), at a lateral forefoot area of the sole structure (e.g., to provide added support for cutting or turning actions), and/or at other desired locations (e.g., to provide desired support and/or flexibility, including natural motion flexibility characteristics).

Figure 8E:
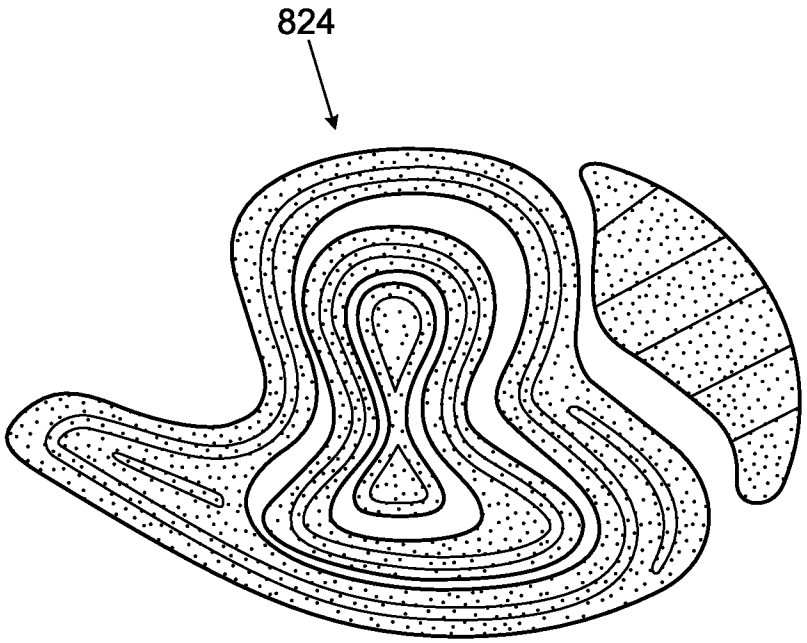
Figure 8D:
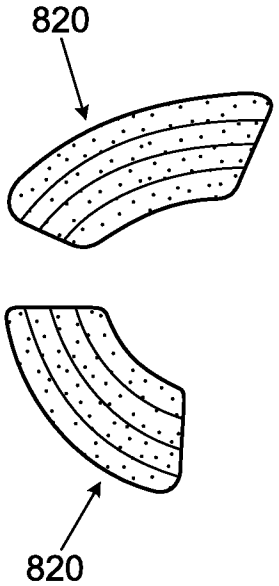
Figure 8F:
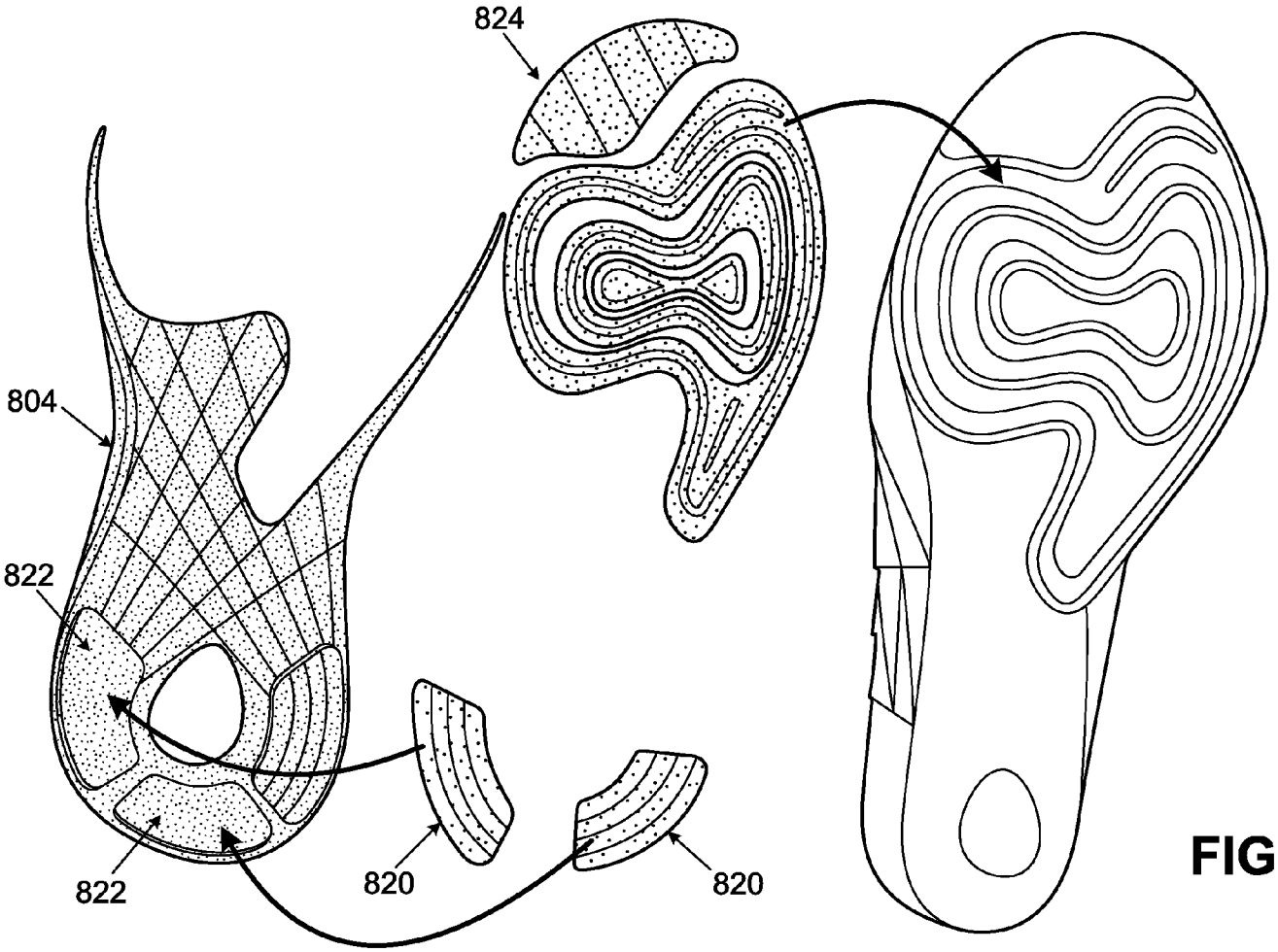

The bottom surfaces of either or both of the foam midsole component 802 and/or the protective component 804 may be provided with additional components. For example, for at least some portions of the sole structure 800 that will contact the ground in use, abrasion resistant or wear resistant material may be applied to at least portions of the bottom surfaces of these components, in order to improve their wear resistance and durability features. FIG. 8D illustrates example outsole components 820 that may be applied to the bottom surface of the protective component 804, optionally, in receptacles 822 formed (e.g., molded or cut) in the heel area of the protective component 804. FIG. 8E illustrates example outsole components 824 that may be applied to the bottom surface of the foam midsole component 802, optionally, in receptacles or other areas formed (e.g., molded or cut) in the forefoot area (area 826) of the foam midsole component 802. FIG. 8F illustrates these parts and how they fit together. These outsole components 820 and 824 may be made from any desired outsole material (or combinations of outsole materials) without departing from this invention, including rubbers, thermoplastic polyurethanes, and the like. Additionally or alternatively, one or more of the outsole components 820, 824 may constitute cleat structures or receptacles for receiving detachable cleat structures.

Figure 9:
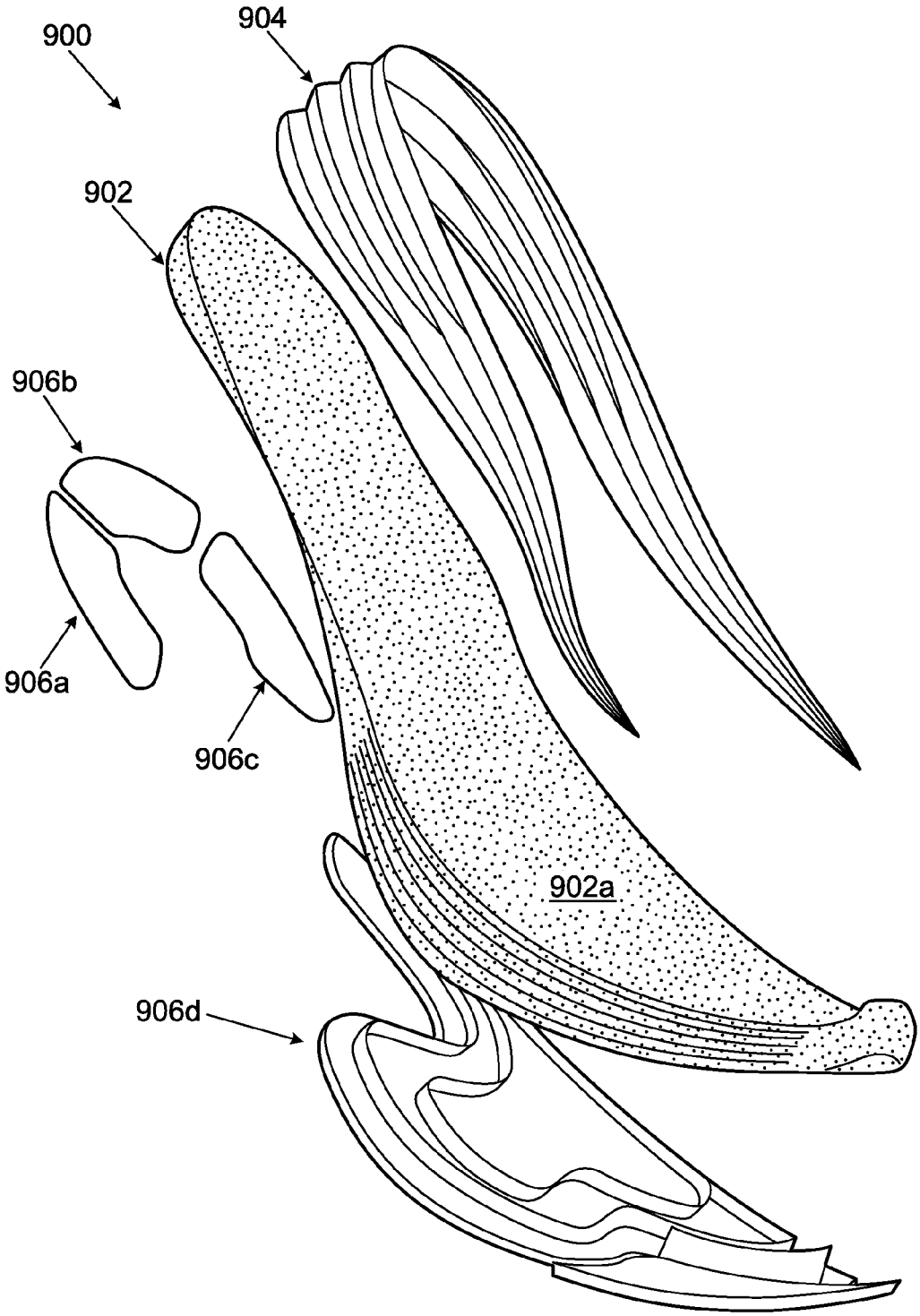
FIG. 9 is an exploded view of a sole structure according to another example of this invention.

FIG. 9 provides an exploded view of another example sole structure 900 in accordance with some examples of this invention. In this sole structure 900, a lightweight foam midsole component 902 (e.g., of the types described above) includes a support surface 902*a* for supporting all or substantially all of the planter surface of a wearer's foot. A foam protective component 904 (optionally including any desired type of billows structures) extends around at least the sides of the midsole component 902 and acts as a cage or carrier for that portion of foam midsole component 902 it contains (from the lateral midfoot or forefoot area, around the rear heel area, to the medial midfoot or forefoot area, in this example). A plurality of outsole protective components 906*a*, 906*b*, 906*c*, and 906*d* are provided to protect various areas of the bottom of the foam midsole component 902 (and/or the bottom of the protective component 904, should the protective component 904 be exposed at the exterior bottom surface of the sole structure 900). In this illustrated example, outsole component 906*a* protects one heel side of the foam midsole component 902 (and/or the protective component 904), outsole component 906*b* protects a rear heel area of the foam midsole component 902 (and/or the protective component 904), and outsole component 906*c* protects the other heel side of the foam midsole component 902 (and/or the protective component 904). A relatively large outsole protective component 906*d* at the forefoot area covers much, if not all, of the forefoot area of the bottom of the foam midsole component 902 (and/or the protective component 904). These various components may be engaged with one another in any desirable manner, for example by cements or adhesives, by mechanical connectors, or any other manner as is known and used in the art. These components may be made, for example, from any of the materials described above for the corresponding parts. Also, any of the individual components shown or described above in FIG. 9 may be made from one or more separate parts without departing from the invention.

While FIGS. 5-9 show sole structures in which the lightweight midsole component is at least partially covered by a protective component in the heel and/or midfoot areas (and extending out to be exposed at the forefoot area of the sole structure), other configurations are possible without departing from the invention. For example, if desired, exposed portions of the lightweight midsole component and the protective component could essentially "flip-flop" ends in the structures of FIGS. 5-9 such that the lightweight midsole component is covered by the protective component in the forefoot and/or midfoot areas (and extends out to be exposed at the heel area of the sole structure). Modifications to the sizes, shapes, and/or junction areas between the lightweight midsole component and the protective component also may be varied widely without departing from the invention.

Figure 10A:
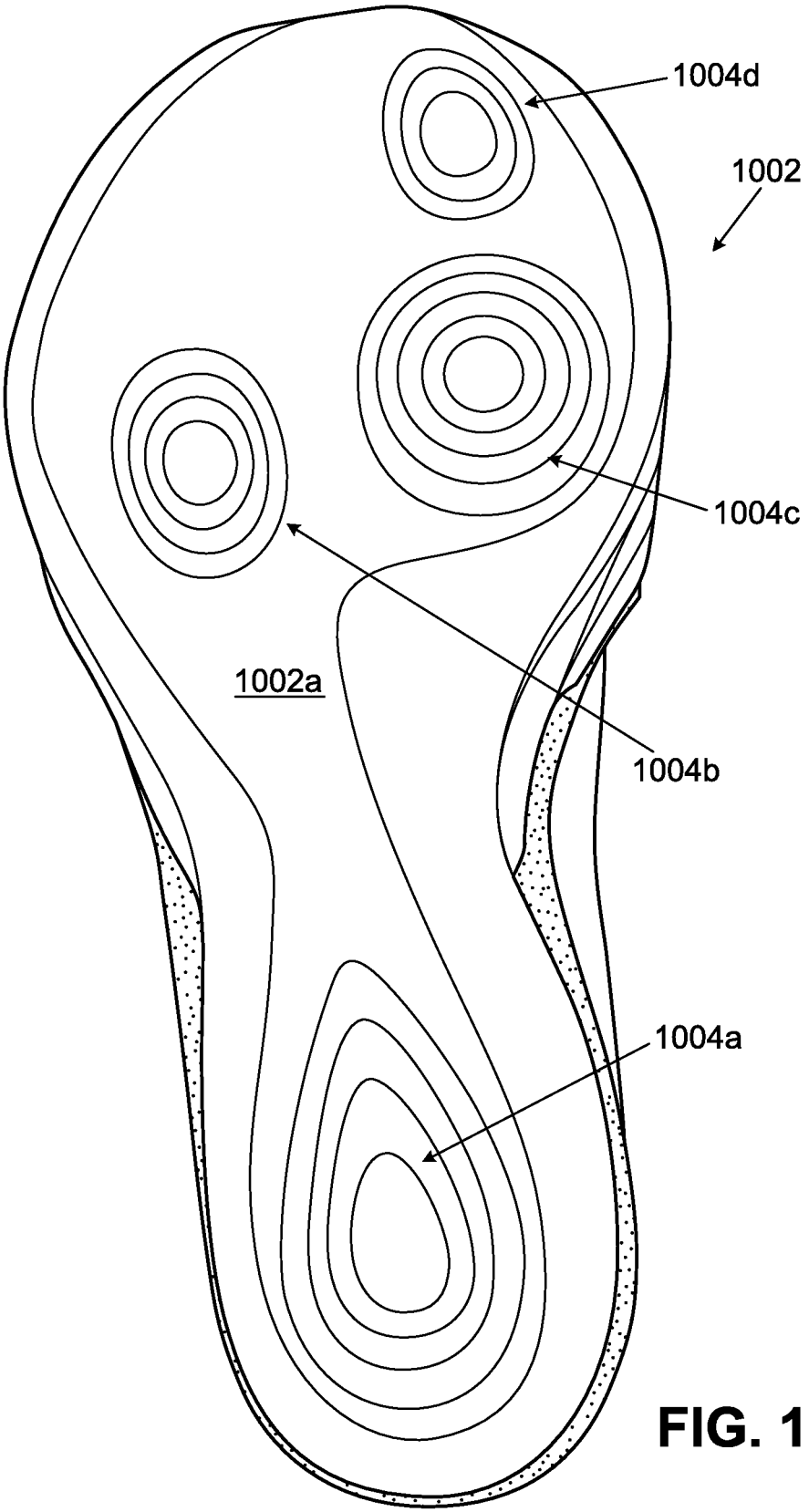
FIGS. 10A and 10B illustrate features of a sole structure according to another example of this invention.
Figure 10B:
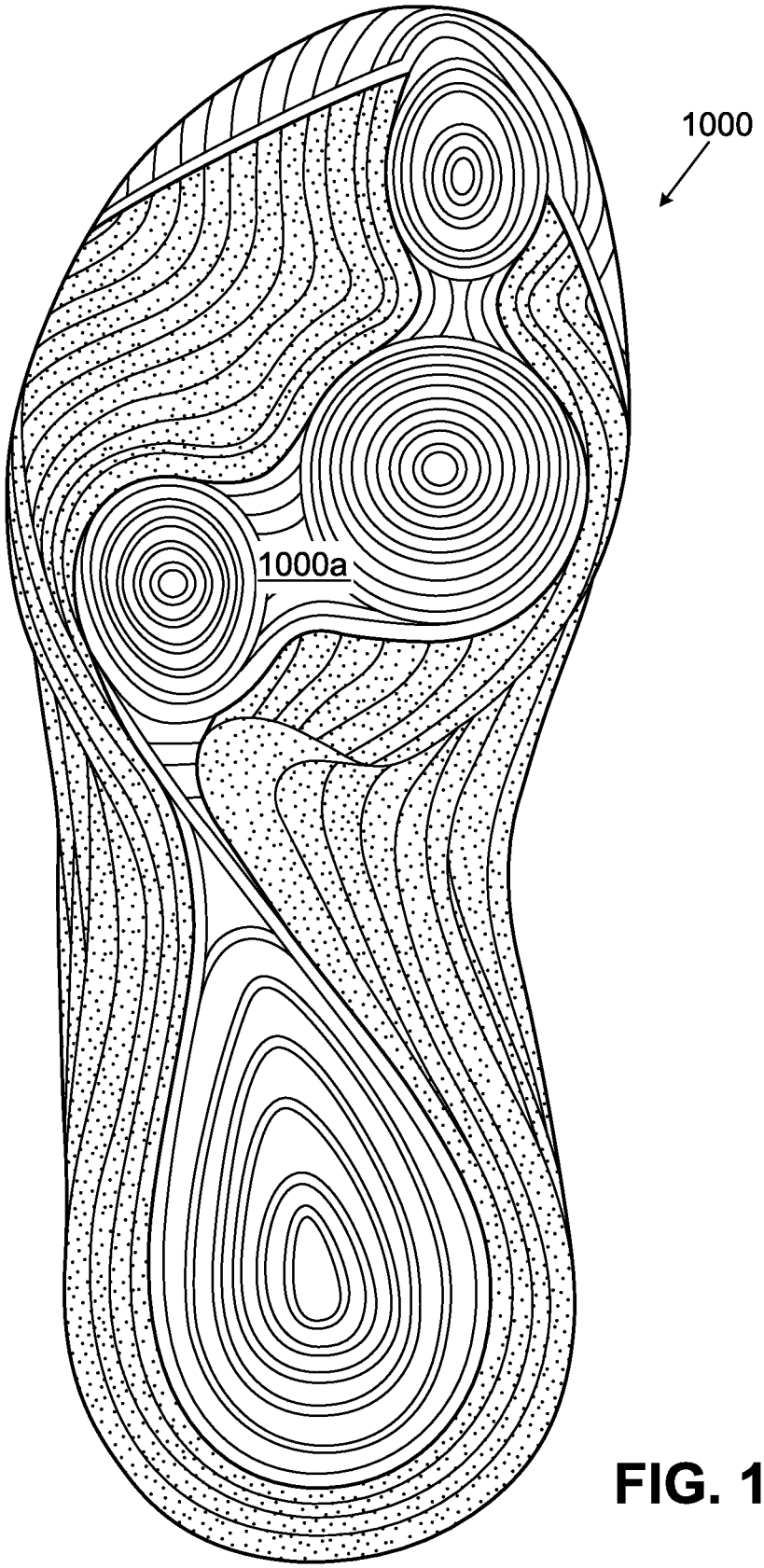

FIGS. 10A and 10B show additional features that may be included in sole structures in accordance with at least some examples of this invention. FIG. 10A shows the bottom surface 1002*a* of a lightweight midsole component 1002, like those described in detail above. The bottom surface 1002*a* of this example lightweight midsole component 1002 includes a plurality of extended out or "bulbous" areas at various locations the midsole component 1002. One bulbous area 1004*a* is provided in the rear heel area of the midsole component 1002 and provides additional impact force attenuation and/or a comfortable, soft feel, e.g., for when the wearer lands a step or a jump. Additional bulbous areas are provided in the forefoot area of the sole structure 1000. More specifically, a bulbous area 1004*b* is provided, e.g., under the fifth metatarsal head region on the lateral side of the midsole component 1002. A third bulbous region 1004*c* is located centered somewhat forward and medial with respect to a center of bulbous area 1004*b* (e.g., at the lateral side located under the first metatarsal head support area of the sole (i.e., beneath the metatarsal head area of the big toe). A fourth bulbous region 1004*d* is located forward of the third bulbous region 1004*c* (e.g., at the lateral side located under the big toe and/or adjacent toe).

The bulbous areas 1004*a*-1004*d* in this example structure 1002 are arranged so as to provide additional impact force attenuation and/or a comfortable, soft feel under the wearer's foot during certain activities, such as running (or walking), landing a step or jump, launching a jump, etc. During a typical step cycle, a runner lands a step toward the lateral heel side of the foot. Bulbous area 1004*a* is provided in the rear heel area of this midsole component 1002 to provide additional impact force attenuation and/or a comfortable, soft feel at this heel strike time. As the step continues, the foot rolls forward and the lateral side edge of the sole contacts the ground. Bulbous area 1004*b* is provided at the lateral side area (beneath the little toe) of this midsole component 1002 to provide additional impact force attenuation and/or a comfortable, soft feel at this time in the step cycle. As the foot rolls forward, it also begins to roll inward, toward the medial side, and eventually the runner pushes off from the ground using the first metatarsal head area and/or the big toe (and possibly the adjacent toe). Bulbous areas 1004*c* and 1004*d* are provided at the medial forefoot side area (beneath the ball of the foot and/or the big toe area) of this midsole component 1002 to provide additional impact force attenuation and/or a comfortable, soft feel at these times in the step cycle.

FIG. 10B shows an illustration of the bottom surface 1000*a* of a sole structure 1000 that incorporates a midsole component 1002 of the type described above with respect to FIG. 10A included therein. As shown in this figure, the bottom of the sole structure 1000 includes traction elements and/or other features that underlie the bulbous areas 1004*a*-1004*d* (e.g., formed as part of a thin web type protective component as will be described in more detail below). The bulbous nature of the sole structure 1000 at the various locations and the foam material above those locations help provide good impact force attenuation at the bulbous areas 1004*a*-1004*d*. Additionally or alternatively, if the foam material of the midsole component 1002 is sufficiently responsive, at least some of these bulbous areas 1004*a*-1004*d* may provide return energy to the foot (e.g., apply a foot lifting force to the wearer's plantar surface as the impact force is lessened (as the foot lifts for the next step) and the foam midsole component 1002 returns to its original shape).

While four distinct bulbous areas are described and spaced apart in the manner described above with respect FIG. 10A, this is not a requirement. Rather, any desired pattern of bulbous areas, including more or fewer bulbous areas, may be provided in a midsole component without departing from this invention. Sole structures in accordance with examples of this invention may include any number of bulbous areas, including no bulbous areas; one, two, or more bulbous areas (arranged in any desired manner). Bulbous area(s) may be arranged to provide impact force attenuation, a soft feel, and/or return energy at any desired location(s), optionally depending on the intended use of the shoe. Bulbous areas of these types also are visible at the bottom of the sole structures shown in FIGS. 2B-2F, 3A, 3B, and 7, and may be included in any desired sole structure.

Figure 11A:
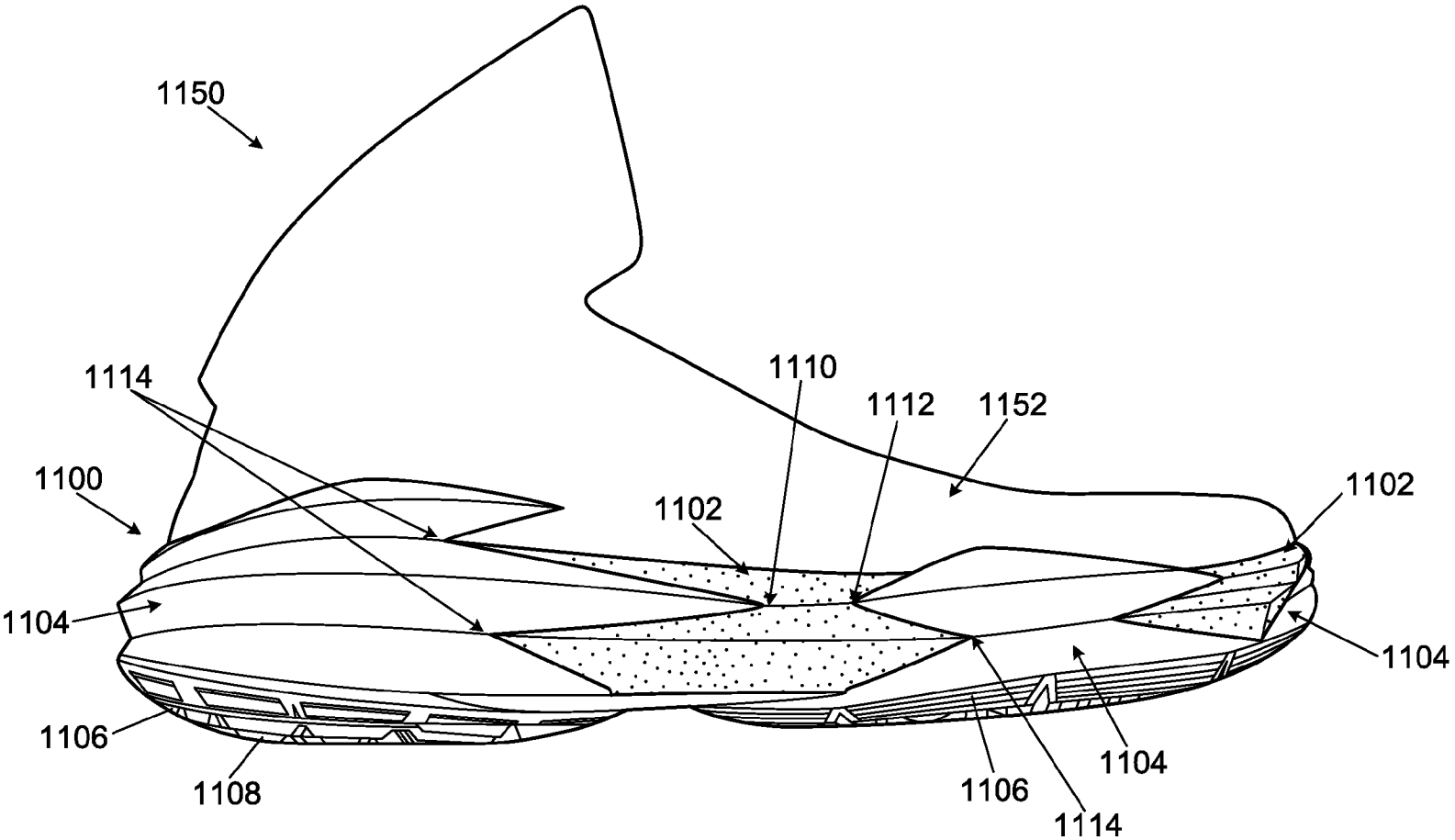
FIGS. 11A-11C provide various views of an article of footwear according to another example of this invention.
Figure 11B:
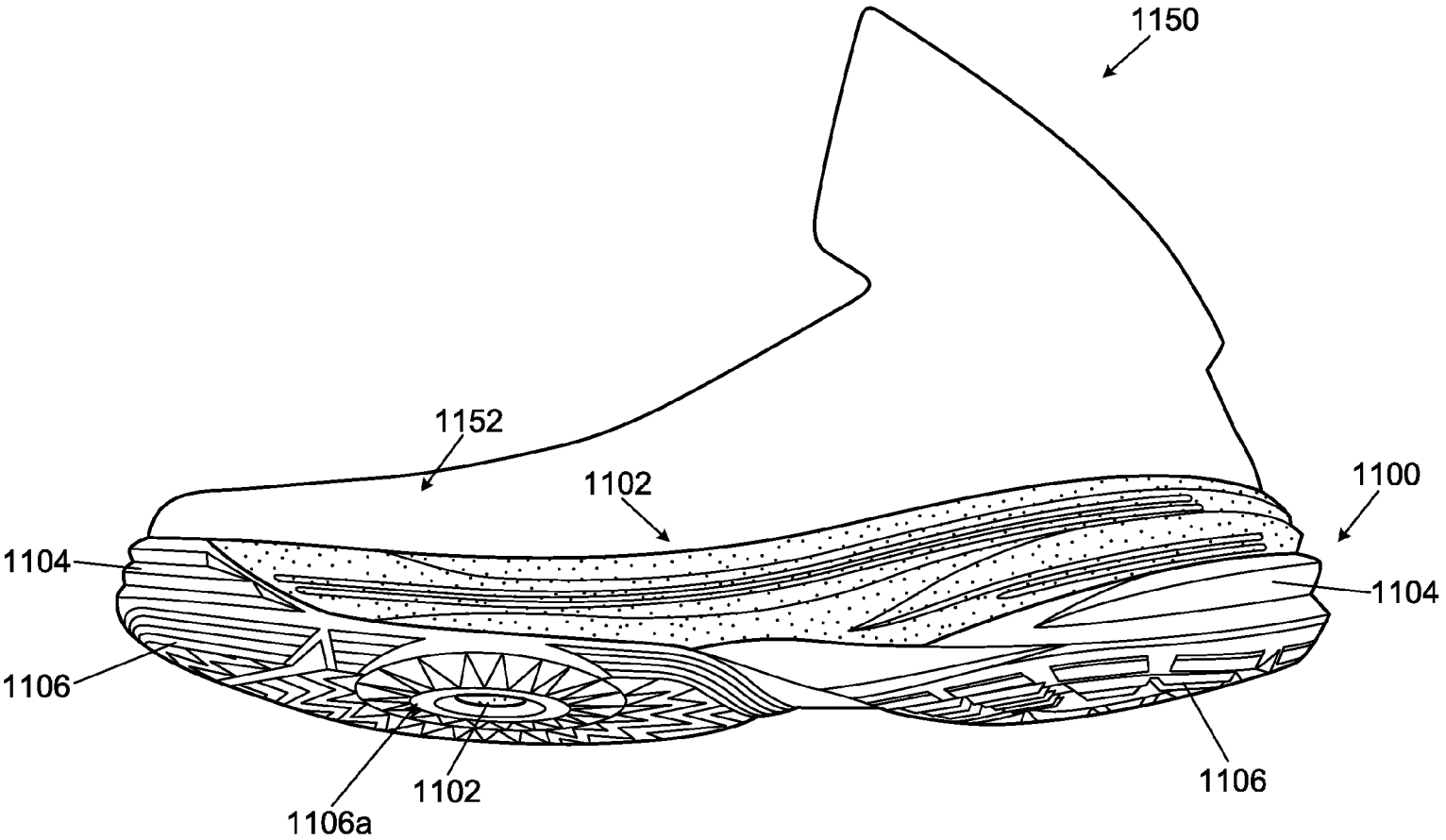
Figure 11C:
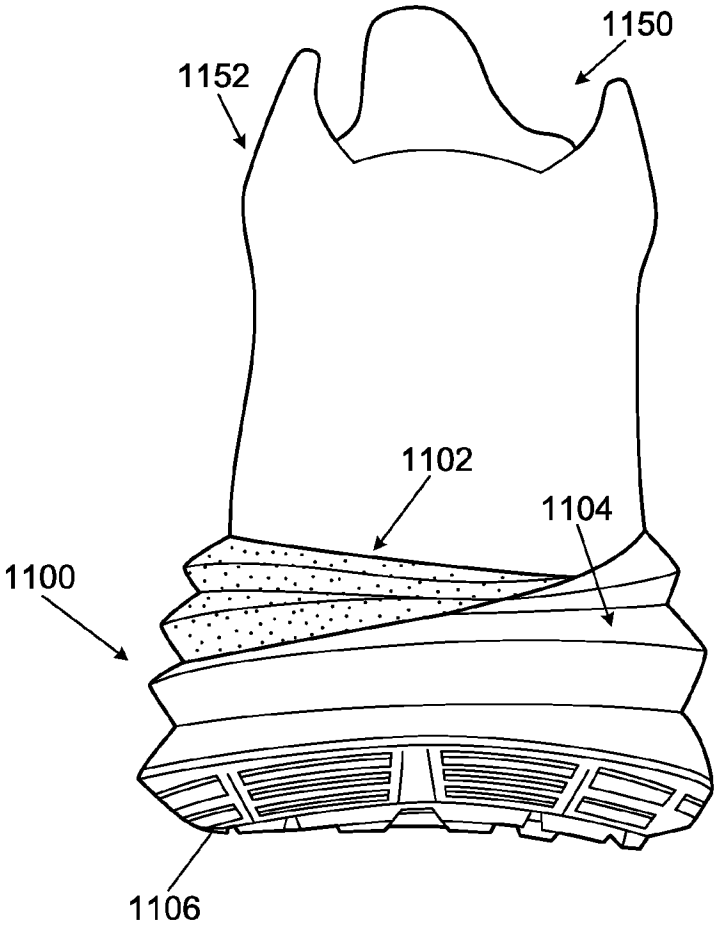

FIGS. 11A-11C show another example basketball shoe 1150 that includes a sole structure 1100 in accordance with at least some examples of this invention. FIG. 11A is lateral side view of the shoe 1150, FIG. 11B is a medial side view of the shoe 1150, and FIG. 11C is a rear heel view of the shoe 1150. This shoe 1150 includes an upper 1152 having a multi-layered, fuse bonded type of upper construction, although other constructions may be used without departing from this invention. The upper 1152 is engaged with a sole structure 1100 that includes features in accordance with at least some examples of this invention. The upper 1152 may be engaged with the sole structure 1100 in any desired manner without departing from the invention, including in conventional manners as are known and used in the art. As some more specific examples, the upper 1152 and sole structure 1100 may be engaged with one another, for example, by cements or adhesives, by mechanical connectors, by stitching or sewing, or the like.

The sole structure 1100 of this illustrated example includes three main components parts. The first part constitutes a lightweight (and low density) midsole component 1102, for example, of the various types described above. This foam midsole component 1102 may extend to support all or substantially all of the plantar surface of a wearer's foot. Portions of the midsole component 1102 are exposed at the outer surface of the footwear structure 1150 at various locations in this illustrated example, including: (a) along the lateral side edge, at least at the midfoot area (see FIG. 11A); (b) at a forward toe area (optionally, at least at the lateral side; see FIG. 11A); (c) along all or substantially all of the medial side edge (see FIG. 11B); and (d) at a portion of the upper rear heel area on the medial side (see FIG. 11C). This foam midsole component 1102 provides a soft and comfortable feel for the wear's foot, as generally described above with respect to the other lightweight foam midsole structures.

The second part of this example sole structure 1100 is a protective component 1104 that at least partially contains the foam midsole component 1102. The protective component 1104 of this illustrated example constitutes a polymeric foam type protective component that may have a denser or heavier foam construction than the foam material of the lightweight foam midsole component 1102. In this illustrated example, one portion of the protective component 1104 extends from a lateral midfoot and/or heel area of the sole structure 1100, around the rear heel area of the sole structure 1100, and over to a medial heel area sole structure 1100. As best shown in FIG. 11C, the foam midsole component 1102 extends outward from behind the protective component 1104 and is exposed at the exterior surface of the shoe 1150 at the rear heel area of this sole structure 1100. Another portion of the protective component 1104 is provided at the lateral forefoot area of the shoe 1150, as shown in FIG. 11A. This lateral forefoot portion of the protective component 1104 may be integrally formed with the protective component part 1104 at the rear heel area as a unitary, one-piece construction, or it may be a separate part. Another portion of the protective component 1104 of this example is provided at the extreme forward toe area of the sole structure 1100, extending around the forward toe area from the medial side to the lateral side. This forward toe lateral forefoot portion of the protective component 1104 may be integrally formed with one or more of the other protective component parts 1104 described above (as a unitary, one-piece construction), or it may be a separate part.

The third part of this example sole structure 1100 is an outsole element 1106, which also may function as a protective component, that is engaged with the bottom side of the midsole foam component 1102 and/or one or more of the polymeric foam protective components 1104. The outsole element 1106 of this example sole structure 1100 covers a major portion of the bottom surface of the shoe 1150. It may include traction elements, such as grooves, ridges, nubs, herringbone, and/or other traction enhancing components. One or more outsole nubs, such as nub 1108, may cover and directly contact a bulbous area of the bottom surface of the foam midsole component 1102 (like the bulbous areas described above in conjunction with FIG. 10A to provide a soft contact area of the sole structure 1100. As also shown in FIG. 11B, this example outsole component 1106 includes an opening defined through it at which a bottom surface of midsole member 1102 is exposed.

The outsole element 1106 may be made from a thin, highly flexible material, which may have a base surface thickness (i.e., a thickness of its base sheet or web surface at locations not through a nub, a raised rib, a traction element, or the like) of less than 3 mm, and in some examples, a base thickness of less than 2 mm, less than 1.5 mm, or even less than 1 mm, in some examples. This thin, flexible outsole element 1106 may be formed from synthetic rubber having a hardness and other properties similar to those of synthetic rubber compounds conventionally used for footwear outsoles. This thin outsole web structure permits outsole element 1106 to flex significantly between adjacent lugs 1108 and/or other structural components. In some sole structures, portions of outsole element 1106 may be formed from a rubber compound that is harder and more durable than other portions of the outsole element 1106. The higher durability rubber could be used, e.g., in a crash pad located within the heel region and/or on the bottoms of lugs located in certain other high pressure regions that typically wear more quickly.

As shown in FIG. 11A, the protective component 1104 of this example sole structure 1100 has a billows structure (with three outer billow ridges) that appears similar, at least in some regards, to the billows structure described above in conjunction with FIG. 4. As shown in FIG. 11A, the central billow of the protective element 1104 that extends around the heel area terminates between billow ridges of a two-billows structure provided in the foam midsole component 1102 at the lateral midfoot area (at termination point 1110). A portion of another, forward billows structure for the lateral forefoot protective component 1104 originates in the interstitial area between the two billow ridges of the foam midsole component 1102 at point 1112. The billows structure of the foam midsole component 1102 originates in interstitial areas between billows of the protective elements 1104 located forward and rearward of that billows structure of the foam midsole component 1102 (see points 1114).

As shown in FIG. 11C, the three billow structure at the lateral side of the protective component 1104 reduces down to a two billow structure at the bottom medial heel side of the protective component 1104. As the foam midsole component 1102 emerges from beneath the protective component 1104 at the rear heel area, the foam midsole component 1102 forms a two billows structure that overlies the two billows structure of the protective component 1104 at the medial side of the sole structure 1100. Therefore, in this example sole structure 1100, the billows structure extending around the heel morphs from a three billows structure on one side to a four billows structure on the other side. At the medial side of the sole structure 1100, as shown in FIG. 11B, the billows structure of the protective component 1104 terminates at the low, medial heel region of the sole structure 1100. The billows structure of the foam midsole component 1102 extends further forward, and the top outer ridge of this billows structure extends forward in a somewhat wavy or curved manner. An independent and shallower billows structure runs around the forward toe area along the side edge of protective component 1104 and/or exposed foam midsole component 1102, as shown in FIGS. 11A and 11B.

Figure 12A:
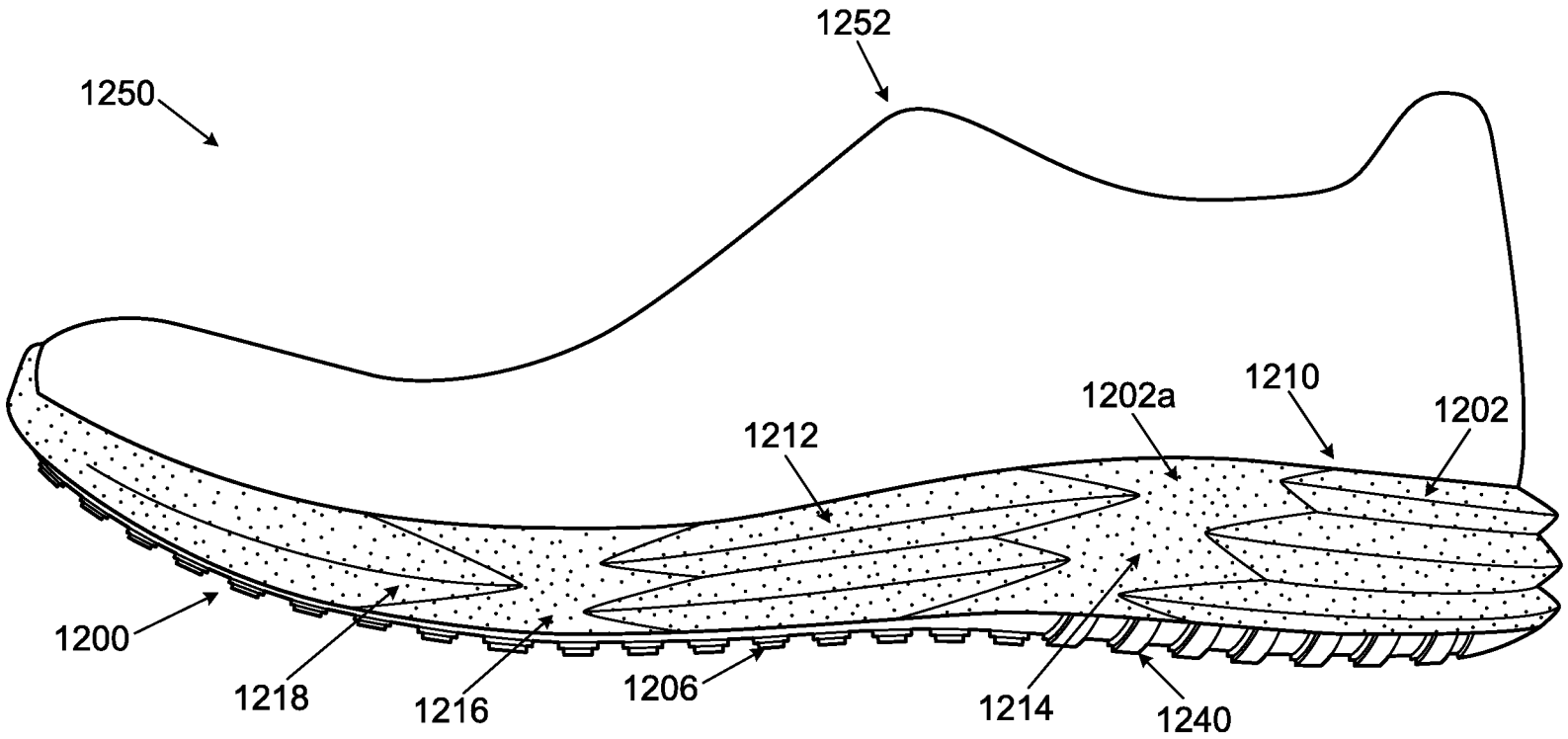
FIGS. 12A-12C provide various views of an article of footwear according to another example of this invention
Figure 12B:
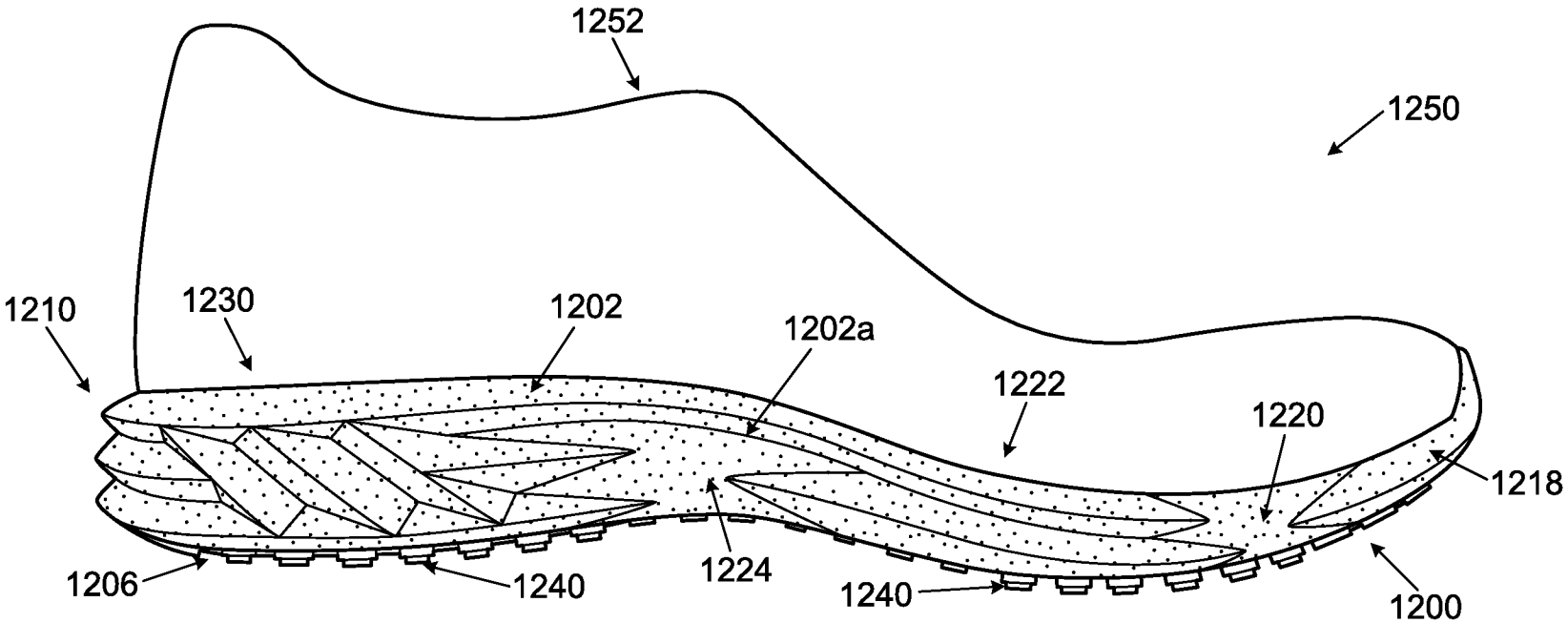
Figure 12C:
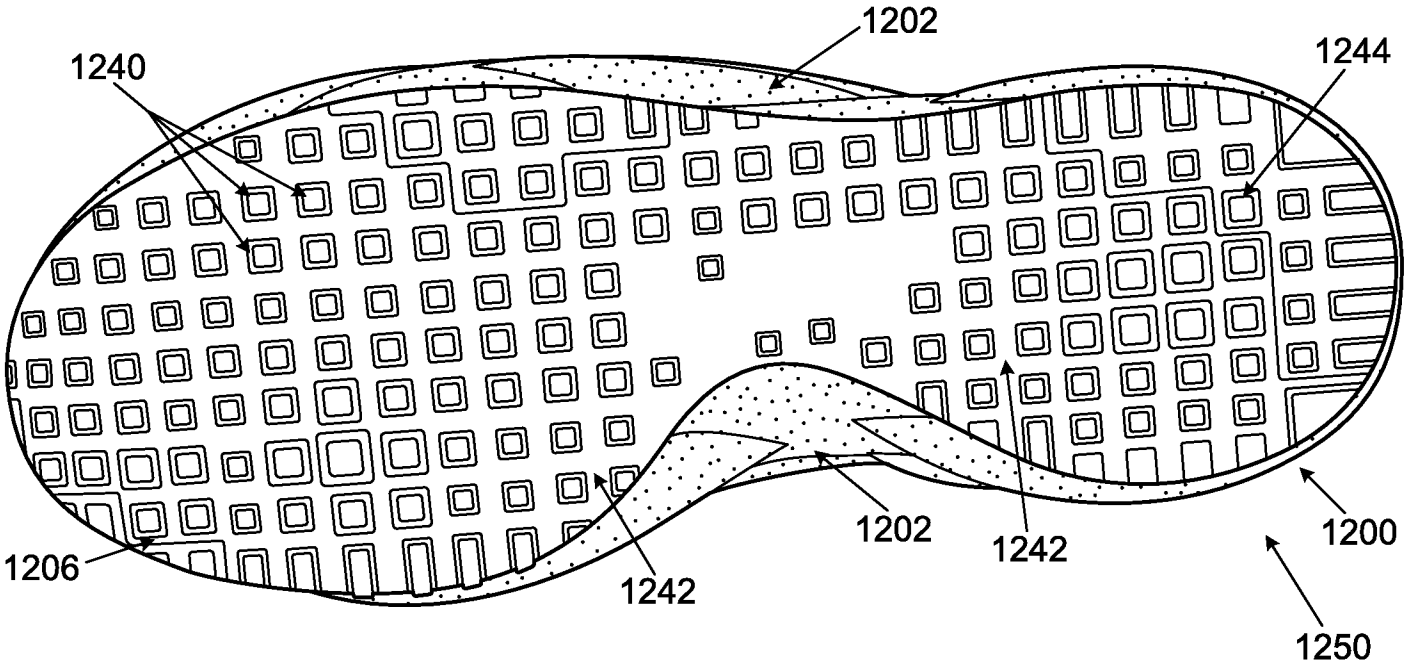

While several of the example sole structures described above included: (a) a foam midsole component, e.g., made of a lightweight foam material, and (b) another foam polymeric material as a protective element, optionally made from a heavier and denser polymeric foam material, it is not a requirement that a sole structure in accordance with this invention have two different polymeric foam materials. Rather, as described above with respect to, for example, FIGS. 1A-2F, if desired, a protective component in the form of an outsole component may be provided on at least a portion of a bottom of a lightweight and less dense foam midsole component without the need for another polymeric foam protective component in the sole structure. FIGS. 12A-12C illustrate another example sole structure 1200 in which a lightweight and less dense foam midsole component 1202 (e.g., of the types described above) is protected over at least portions of its bottom surface with an outsole component 1206, without the inclusion of another polymeric foam protective material at any other location in the sole structure 1200.

FIG. 12A illustrates a lateral side view, FIG. 12B illustrates a medial side view, and FIG. 12C illustrates a bottom view of this example sole structure 1200 and article of footwear 1250 in accordance with this example of invention. This example article of footwear 1250 is a running shoe, and it includes an upper 1252 constructed, for example, of any of the various materials described above. As some more specific examples, the upper 1252 may be made, at least in part, from a textile material, such as a mesh material, a knitted material, or the like. The upper 1252 may be engaged with the sole structure 1200 in any conventional manner, for example, using adhesives or cements.

While not required to have any billows structure, the side surface 1202*a* of the lightweight midsole component 1202 of this example structure 1200 does include various billows structures, although the overall billows structure of this sole 1200 differs in some regards from the various other billows structures described above. As shown in FIG. 12A, the heel area of this example midsole component 1202 includes a three layered billows structure 1210 extending from the rear heel area around to the lateral side of the shoe 1250. A double layered billows structure 1212 is provided at the midfoot area of this midsole component 1202, and the two layer billows structure 1212 is separated from the rear heel three-layer billows structure 1210 by a segment 1214 of smooth polymeric foam material (a portion of the lightweight midsole component 1202) to thereby provide a gap in the billows structures on the lateral side of the shoe 1200. The midfoot two-layered billows series 1212 terminates at the midfoot/forefoot area of the sole structure 1200. Another smooth segment 1216 of polymeric material (a portion of the lightweight midsole component 1202) produces a gap between the midfoot two-layered billows series 1212 and a single billow 1218 (or raised rib structure) that extends around the toe area of the shoe 1250.

The single forefoot raised rib 1218 of this example structure extends from the lateral side, around the forward toe area, to the medial side of the shoe 1250, as shown in FIGS. 12A and 12B. As illustrated therein, the single billow 1218 terminates at the medial forefoot area. After another short gap 1220 with no billows (in which smooth polymeric foam segment 1220 of this midsole component 1202 is provided), a two layered billows series 1222 begins and extends rearward through the forefoot area. The lower billows of the two layered billows series 1222 terminates in the midfoot area, at which another smooth segment 1224 of midsole material 1202 is provided. The top billows of the two layer billows series 1222, however, extends continuously along the upper edge of the midsole component 1202, at the junction between the midsole component 1202 and the upper 1252. After the smooth segment 1224, the heel billows area 1210 begins on the medial side of the sole structure 1200. Notably, the upper billows of the forefoot billow series 1222 forms the upper billows of the rear heel billows series 1210.

The segments of smooth polymeric foam material of the midsole component 1202, e.g., segments 1214, 1216, 1220, and 1224, provide areas that are somewhat stiffened in the vertical direction as compared to areas supported by the various billow structures. In this example structure 1200, notably one smooth gap segment 1214 is provided in the lateral heel area of the sole structure 1200. This segment 1214 provides additional support for a runner's foot when landing a step during a running step cycle. The smooth gap segment 1216, also on the lateral side of the sole structure 1200, is located at or near the fifth metatarsal head area of the sole structure 1200. At this location, the somewhat stiffened smooth segment 1216 provides additional support under the fifth metatarsal head area as the foot rolls forward during continuation of the step cycle. Smooth gap segment 1220 is located at the medial forefoot or toe area of the sole structure 1200 and provides additional support for the big toe area of the wearer, e.g., during the pushoff phase of the step cycle. Smooth gap segment 1224 is provided in the arch area of the shoe 1250 and provides additional arch support for the wearer.

The heel billows structure 1210 of this example sole structure 1200 is interrupted in the medial heel side area by a series of angularly oriented support ribs 1230. In this illustrated example, the support ribs 1230 are angled in a top rear-to-bottom forward direction. The ribs 1230, however, may be oriented at any desired angle without departing from this invention, including at a vertical angle (90° from horizontal) when the sole 1200 rests on a horizontal surface. As additional examples, the ribs 1230 may be oriented at an angle within the range of 25° to 90°, with respect to the horizontal direction (when the sole 1200 rests on a horizontal surface). The ribs 1230, when angled other than vertical, may be angled in the opposite direction from that shown in FIG. 12B, i.e., in a rear bottom-to-forward top direction. Not all ribs in a series where more than one rib is present need to extend at the same angle as another rib (although all ribs may be parallel, if desired).

These ribs 1230 provide additional support for the medial side of the foot during the step cycle, for example, to prevent overpronation during a step cycle. While other arrangements are possible, in this illustrated example sole structure 1200, the ribs of area 1230 extend from the top billows element to the bottom billows element of the rear heel billows series 1210. In this manner, the ribs 1230 extend integrally from the top and bottom billows ridges, and the ribs 1230 interrupt the center billows of the three layered billow series 1210. Also, while three support rib elements 1230 are shown in FIG. 12B, one, two, or more rib elements 1230 of this type could be provided as this type of medial heel support without departing from the invention.

Also, the ribs 1230 of a series on an individual shoe 1250 may have any desired shape without departing from the invention, including a triangular cross-sectional shape a rounded cross-sectional shape, a flat or rectangular cross sectional shape, etc. When more than one rib is present in a series on a sole structure 1200, the various ribs 1230 of that series need not all have the same identical shape and/or even the same general shapes. Rather, the shapes of the rib elements 1230 may vary widely even in an individual shoe 1250 without departing from the invention.

Turning now to FIG. 12C, the outsole structure 1206 (or protective element) of this example article of footwear 1250 will be described in more detail. The outsole element 1206 may be engaged with the bottom side of the midsole foam component 1202, e.g., using cements or adhesives. The outsole element 1206 of this example sole structure 1200 covers a major portion of the bottom surface of the shoe 1250. While it may include any desired types of traction elements and/or traction element configuration, in this illustrated example, the traction elements constitute mainly raised nubs (or lugs) 1240 spaced around the bottom of the sole structure 1200 in a generally matrix pattern. If desired, one or more outsole nubs 1240 may cover and directly contact a bulbous area of the bottom surface of the foam midsole component 1202 (like the bulbous areas described above in conjunction with FIG. 10A) to provide a soft contact area of the sole structure 1200.

This outsole element 1206 is made from a thin, highly flexible material, which may have a base surface thickness (i.e., a thickness of its base sheet or web surface at locations 1242 between nubs 1240) of less than 3 mm, and in some examples, a base sheet or web surface thickness of less than 2 mm, less than 1.5 mm, or even less than 1 mm. While FIG. 12C shows the nubs 1240 as generally square or rectangular and substantially arranged in rows or columns (as a matrix), any desired nub shape(s) and/or nub arrangement(s) and/or spacing(s) may be provided on a sole structure without departing from the invention. The outsole element 1206 of this example sole structure 1202 also may have any of the structures, features, or characteristics of similar thin sole components as described in U.S. patent application Ser. No. 13/693,596 filed Dec. 4, 2012 and entitled "Article of Footwear," which application is entirely incorporated herein by reference.

This thin, flexible outsole element 1206 may be formed as a sheet like material, e.g., from synthetic rubber having a hardness and other properties similar to those of synthetic rubber compounds conventionally used for footwear outsoles. This thin outsole web structure permits outsole element 1206 to be very lightweight and to flex significantly between adjacent nubs 1242. In some sole structures, portions of outsole element 1206 may be formed from a rubber compound that is harder and more durable than other portions of the outsole element 1206, or the outsole component web area 1242 may be made somewhat thicker in some areas than others. The higher durability or thicker rubber could be used, e.g., in a crash pad area 1244 located within the heel region, on the bottoms of lugs located in certain other high pressure regions that typically wear more quickly, along the lateral edge of the outsole 1206, etc. FIG. 12C further shows that this example thin web type outsole structure 1206 is perforated at some locations (e.g., in the forefoot and midfoot areas, in this example). Also, as further shown, the nub size (e.g., height, cross sectional dimensions, cross sectional shapes, etc.) may vary over different areas of the outsole structure 1206.

The thin web outsole member 1206 is engaged with the polymeric foam member to cover at least 60% of a surface area of a bottom surface of the midsole component 1202, and in some examples at least 80%, at least 90%, or even at least 95% of this surface area. At least a majority of the web base surface (a majority of the surface area between traction elements) will have a thickness that is less than 2 mm thick, and in some examples less than 1.5 mm or even less than 1 mm thick. If desired, at least 75%, at least 85%, at least 90%, or even at least 95% of the web base surface (surface area between traction elements) will have the thickness characteristics noted above.

III. Conclusion

The present invention is disclosed above and in the accompanying drawings with reference to a variety of examples. The purpose served by the disclosure, however, is to provide examples of the various features and concepts related to the invention, not to limit the scope of the invention. Features of one example structure may be provided, used, and/or interchanged in some of the other structures, even though that specific combination of structures and/features is not described. One skilled in the relevant art will recognize that numerous variations and modifications may be made to the structures-described above without departing from the scope of the present invention, as defined by the appended claims.

What is claimed is:

1. An article of footwear, comprising:

an upper;

a sole structure engaged with the upper, wherein the sole structure includes a first portion configured to support at least a heel and midfoot area of a wearer's foot, wherein an exposed outer edge of the first portion includes a billows structure that extends continuously from a medial midfoot or forefoot area of the sole structured to a lateral midfoot or forefoot area of the sole structure, and wherein the billows structure includes a plurality of billow outer ridges connected by billow interstitial areas located between adjacent billow outer ridges of the billow outer ridges, the plurality being fewer than five billow outer ridges, wherein at least some of the billow ridges extend downwardly from rear ends of the ridges toward a midfoot of the sole structure, wherein at least some of the billow ridges extend downwardly from front ends of the ridges toward a midfoot of the sole structure, and wherein an upper surface of the billows structure is secured to the upper; and an outsole assembly secured to a bottom surface of the sole structure.

2. The article of footwear of claim 1, wherein the outsole assembly comprises a plurality of outsole components.

3. The article of footwear of claim 2, wherein the outsole components are secured to a bottom surface of the sole structure.

4. The article of footwear of claim 1, wherein the sole structure is configured to support an entire plantar surface of a wearer's foot.

5. The article of footwear of claim 1, wherein the first portion is a polymeric foam member.

6. The article of footwear of claim 5, wherein the polymeric foam member constitutes an outer shell including the billows structure, wherein the outer shell includes:

a lateral side wall, a medial side wall, a rear heel wall connecting the medial side wall and the lateral side wall, and a bottom wall connecting the medial side wall, the lateral side wall, and the rear heel wall, and wherein the billows structure extends continuously around an exterior surface of the lateral side wall, the rear heel wall, and the medial side wall.

7. The article of footwear of claim 1, wherein the first portion includes a foam material having a hardness of between 25 and 45 Asker C.

8. The article of footwear of claim 1, wherein the first portion includes a foam material having a hardness of between 25 and 35 Asker C.

9. The article of footwear of claim 1, wherein the first portion includes a foam material having a hardness of between 35 and 45 Asker C.

10. The article of footwear of claim 1, wherein the first portion includes a foam material having a density of less than 0.25 g/cm3.

11. The article of footwear of claim 1, wherein, at a rear heel area of the first portion, a highest billow outer ridge is vertically separated from a lowest billow outer ridge by a vertical distance of at least 1.5 inches when the sole structure is oriented on a horizontal surface.

12. The article of footwear of claim 1, wherein the billow ridges have a thickness at a rear end of the first portion that is larger than a thickness at a front end of the first portion.

13. The article of footwear of claim 1, wherein a rear end of an uppermost of the billow ridges extends rearwardly less than at least one of the billow ridges below the uppermost billow ridge.

* * * * *